US005842722A

United States Patent [19]

Carlson

[11] Patent Number: 5,842,722

[45] Date of Patent: Dec. 1, 1998

[54] PRINTABLE COPLANAR LAMINATES AND METHOD OF MAKING SAME

[76] Inventor: Thomas S. Carlson, 19 Mid Oaks Rd., St. Paul, Minn. 55113-5612

[21] Appl. No.: 66,034

[22] PCT Filed: Sep. 19, 1991

[86] PCT No.: PCT/US91/06803

§ 371 Date: May 15, 1993

§ 102(e) Date: May 15, 1993

[87] PCT Pub. No.: WO92/05036

PCT Pub. Date: Apr. 2, 1992

Related U.S. Application Data

[63] Continuation-in-part of Ser. No. 632,316, Dec. 21, 1990, Pat. No. 5,131,686, which is a continuation-in-part of Ser. No. 585,614, Sep. 20, 1990, Pat. No. 5,096,229.

[51] Int. Cl.[6] ..... B42D 15/00

[52] U.S. Cl. ..... 283/107

[58] Field of Search ..... 283/75, 81, 101, 283/105, 107, 116, 90.4, 36, 37, 38, 39, 40, 41, 42

[56] References Cited

U.S. PATENT DOCUMENTS

| | | | |
|---|---|---|---|
| 3,273,785 | 9/1966 | Beckman et al. . | |
| 3,319,872 | 5/1967 | Beckman et al. . | |
| 4,445,711 | 5/1984 | Cunningham | 283/39 X |
| 4,447,481 | 5/1984 | Holmberg et al. . | |
| 4,525,116 | 6/1985 | Holmberg . | |
| 4,568,403 | 2/1986 | Egan . | |
| 4,579,754 | 4/1986 | Maurer et al. . | |
| 4,588,463 | 5/1986 | Barber et al. . | |
| 4,590,109 | 5/1986 | Holmberg . | |
| 4,618,520 | 10/1986 | Holmberg . | |
| 4,637,635 | 1/1987 | Levine | 283/105 X |
| 4,640,030 | 2/1987 | Wood et al. | 283/116 X |
| 4,732,410 | 3/1988 | Holbein et al. . | |
| 4,763,930 | 8/1988 | Matney . | |
| 4,765,653 | 8/1988 | Fashom et al. | 283/116 X |
| 4,780,974 | 11/1988 | Mitchell . | |
| 4,884,827 | 12/1989 | Kelley . | |
| 4,951,864 | 8/1990 | Dicker . | |
| 4,962,603 | 10/1990 | Kao et al. . | |
| 5,096,229 | 3/1992 | Carlson | 283/75 |
| 5,131,686 | 7/1992 | Carlson | 283/75 |
| 5,401,058 | 3/1995 | Holmberg . | |

FOREIGN PATENT DOCUMENTS

| | | |
|---|---|---|
| 62-158466 | 10/1987 | Japan . |
| 62-158467 | 10/1987 | Japan . |
| 2-45577 | 3/1990 | Japan . |

*Primary Examiner*—Willmon Fridie, Jr.
*Attorney, Agent, or Firm*—Vidas, Arrett & Steinkraus, P.A.

[57] ABSTRACT

A sheetstock for preparing business forms including die-cut identification cards, labels, wrist bands, return envelope mailers, and loose leaf index tabs, which may be imprinted with various types of computerized imaging equipment including, but not limited to, impact printing, hot and cold cut-sheet and continuous form laser (electrophotography) printing, thermal transfer printing, ion deposition printing, magnetic printing (magnetographic), ink jet printing, and LED (light emitting diode) printing. The sheetstock includes various types and configuration of laminates including imprintable plastic or paper adhered to a portion of the sheetstock. The laminate portion is adhered to the core sheet or die cut in such a way as to define one or more die-cut identification cards, labels, wrist bands, return envelope mailers, and loose leaf index tabs. The remainder of the sheetstock includes a second layer of paper adhered thereto which allows the sheetstock to feed through a laser printer feed tray. Alternatively, the core sheet is indented to allow for the added thickness of the adhesive and plastic layers.

21 Claims, 19 Drawing Sheets

30
34
16
32
18
28
12
10
26

30
22
16
20
26
20
22
12
10

32
30
34
16
18
32
26
28
52
12
10

30
22
20
16
26
20
22
52
12

PRINTABLE COPLANAR LAMINATES AND METHOD OF MAKING SAME

CROSS-REFERENCE TO RELATED APPLICATIONS

This application is a Continuation-in-part of application Ser. No. 07/632,316 filed Dec. 21, 1990, now U.S. Pat No. 5,131,686, which is in turn a Continuation-in-part of application Ser. No. 07/585,614 filed Sept. 20, 1990, now U.S. Pat. No. 5,096,229, by the inventor under "Method for Producing Identification Cards."

BACKGROUND OF THE INVENTION

1. Field of the Invention

This invention relates to paper and plastic composite constructions useful in forming die-cut identification cards, labels, wrist bands, return envelope mailers, and loose leaf index tabs with various types of computerized imaging equipment.

2. Description of the Related Art

Many companies desire to have various composite constructions combining paper, adhesives, release liners, coatings and plastics to form identification cards, labels, index tabs, return envelope mailers and wrist bands to be marked with high quality images such as those available by utilizing various types of impact and non-impact imaging technologies. Many imaging, inserting, and printing machines require sheetstock of a designated size and specification such as flat, 8.5" by 11" paper. However, many applications require only a small amount of materials to be imaged and distributed, such as an identification card, label, wrist band, index tab or return envelope mailer. In addition, many applications desire a letter made from paper to be attached to the composite and a means to separate the composite from the core sheet paper letter portion easily and a construction so the composite is made for the application's requirements. Many companies desire a cost effective means to use various forms in inserting equipment and mail various composite materials built into the forms which requires a sheetstock of a size and construction compatible with various automated machinery.

The problems with previous constructions for sheetstocks being constructed with more than one material of unequal size for imaging, printing and inserting had many of the following problems associate with their manufacture and use A thickness buildup in the sheetstock caused uneven stacking when placed in a pad one on top of another or when wound in a roll or placed in a carton causing many problems for infeed and outfeed devices in many types of laser printers, the sheetstock could not be placed in one tray of a multiple tray imaging or inserting machine allowing the sheetstock to be printed in the same print stream with other document so that imaging, matching and collating could be done with other documents using an automated means, the cards fell off of the paper form carriers due to non-coplanar thickness differences that could get snagged in the printers and due to their means of attachment to the carrier sheet, the grain direction of the finished sheetstock may have been long grain which creates more difficult folding in inserting equipment, unnecessary laminate material on the sheetstock that has two layers of equal size adhered together may unnecessarily increase the mailing weight and also cost of the sheetstock, more sheetstock bulk created shorter computer runs and more labor intensive processing in a imaging machine before having to reload the machine and also creates wasted storage and shipping costs, envelopes and mechanized inserting equipment may have been difficult if not impossible to be used due to the sheetstock being non-coplanar, it was difficult to create a self mailer by folding the form and sealing it, high quality bar codes, graphics, text and pictures were difficult to be imaged on the entire sheetstock due to uneven thickness causing feeding problems and the synchronization of the printer being thrown off, low cost personalized paper letters may not have been easily made with two sheets of equal sized adhered materials, imaging on two sides of a sheetstock was difficult if not impossible to accomplish, the card or other end products is often more thick and made from only one material that provides for a flimsy card, cards made from 10 mils of an inch of solid plastic are environmentally wasteful and more expensive, the printing on top of the card is not protected by a plastic layer, the cards had difficulty being marked with high quality images, the cards were often adhered to a carrier sheet slowly and inaccurately, the card and carrier form had to be printed and adhered together forming the sheetstock in two passes of a press, and the laminate may not have been as readily separable from the sheetstock for the application in mind.

Various types of die-cut identification cards, labels, wrist bands, return envelope mailers, and loose leaf index, tabs have been in existence which were limited to imprinting techniques such as hand writing or impact printing (where a hammer in the shape of a character strikes an inked ribbon which then places a mark on the desired material being fed through the printer) that can mark characters on the materials desired. These imprinting methods are limited as to the quality of characters they can mark on various documents and in the case with fixed character impact printers, the direction in which they could image in relation to the paper web path which is at a 90 degree angle to the web.

Due to their construction, some printers including, but not limited to, impact and dot matrix impact printers, hot and cold cut sheet form and continuous form laser (electrophotography), thermal, thermal transfer, ion deposition, magnetic printing (magnetographic), ink jet, and LED (light emitting diode) and photo-copiers are finicky and are often unable to handle varying thicknesses of paper or other materials on the same sheet. In addition, many commercial color printing presses have the same problems in dealing with non-coplanar sheetstock.

Many companies wish to send plastic identification cards to their customers along with a cover letter of paper or other information on paper. Previous attempts to use the printers already described to image identification cards have failed to produce acceptable paper pages bearing plastic die-cut identification cards.

Many new impact and non-impact printers have less paper thickness handling capability. Several types of "non-impact" printers are extremely finicky in the types of materials they can handle and have unique requirements for the materials being fed through them for imaging in order for the material to feed and travel through the printer successfully and create a quality image on the desired material. Thus, in the past, various types of forms that have additional materials adhered on top of the core sheet, such as die-cut identification cards, labels, wrist bands, return envelope mailers, and loose leaf index tabs may not feed and image well, if at all, in many types of printers. New advances in computer printers and software also allow for imaging information in a variety of directions in relation to the sheetstock traveling through them.

Xerox and other laser printer manufacturers' specifications use primarily, if not only, long grain cut sheet paper which makes manufacturing some types of business forms constructions difficult, if not impossible to produce. In particular, if the application requires cards to be placed at the bottom portion of an 8.5 by 11" portrait style sheetstock in order to allow for as much of the sheetstock's paper to be imaged as a traditional letter to go with the identification cards at the bottom of the sheetstock. This is because most, if not all paper only comes on a web from the paper mill in a grain long direction. Thus, when the web is unwound as when run through a rotary printing press, if additional webs are to be unwound, indented with a roller and adhered to the core web and cut in a "portrait" dimension, which may be 8.5" wide and 11" or 14" long as is common with many cut sheet laser printers, and the laminates are desired to be adhered to the sheet in the short direction of the sheetstock to allow for as little plastic to be used as possible and easier folding in inserting equipment as the form is folded with the grain direction, and desires as much space as possible for a paper letter at the top, the grain direction can only be cut grain short contrary to Xerox and other laser printer specifications.

As an example, to make the constructions described above with the sheetstock cut long grain, additional laminates would need to be synchronized with the moving web of paper and placed on top of and adhered to the web of paper during manufacture and then compressed into the sheet of paper by using a roller with a non-continuous knob on it instead of a continuous raised surface that would do the crushing. To dent only a portion of the sheet with a knob on it is possible but expensive to test, develop and consistently produce. This process may also have a tendency to wear out a press faster due to the great amount of pressure needed to compress paper sufficiently, and the bounce in the crushing roller the knob will create in the press.

Previous methods for making identification cards, produced embossed plastic cards, tipped on plastic cards and plain paper cards. Embossed cards are relatively expensive to make. Plain paper cards are inexpensive; however, they are not long lasting and do not convey a polished image. The data image can be chipped off paper fibers. Also, the cards were not water and wear resistant.

Plastic cards have been produced in which an impact printer, or cold fusion continuous form laser printer was used to mark a sheet of die-cut plastic, tipped-on plastic, plastic-coated paper and some full sheet plastic cards. Such impact printers and some cold fusion printers have relatively poor imaging ability and quality in particular when they are imaging on tipped on plastic identification cards. They have difficulty or are unable to form high quality bar codes, text and graphics on such cards and on the same card and paper sheet carrier to which it is adhered. This is because there are two different thicknesses to print on—the thickness of the paper carrier and where the combined thickness of the carrier and card is located. If the printer is adjusted for one thickness the printer does not image as well on the other thickness. Also, some forms and tipped on cards are thicker than the printers were designed to print, which can create problems such as cards snagging on equipment, jamming and cards falling off the carriers. Much computer operator inconvenience is created when cards fall off as the fallen off cards need to be accounted for, the software driving the printer reprogrammed with the fallen off card's data, and the cards reprinted Due to a thickness buildup because of the unequal sheetstock thickness, when fan folded or stacked on top of one another, as is commonly done, the pad of paper will develop an uneven thickness on one side. This lean of the pad can cause the paper forms to get a curl or memory in them when in storage for a long time and create wasted space when packaged, shipped and stored creating extra costs. Tipped on plastic cards adhered to paper sheets will have relatively few forms per unit of space due to their unnecessary bulk which will reduce the potential length of the computer printer run before the operator needs to load the next box of forms. As an example the combined thickness of many tipped on plastic cards is 10 mils and carriers are commonly 24 pound ledger which is 4.5 mils and the adhesive may be 1 mil for a total thickness of 15.5 mils. This reduced length of computer runs can add unnecessary labor costs and inconvenience as computer operators prefer to set up the printer, let it run unattended and have to reload and reset the printer seldom. In addition, some 7 mil or 10 mil cards are rather flimsy because they may not use a layered composite combination of substrate and adhesives that can add stiffness to the card but are made from one material. Many persons do not carry identification cards in their wallets because such cards are thick. People often desire a thin card that takes less space in a wallet but is also durable. In addition, the adhesive holding, it in place must allow for the recipient to remove the card from the form but at the same time keep the form on the sheetstock which may create difficulties and aesthetic problems. Tipped on cards were also impossible to image on two sides with a computerized printer as the back side was adhered to a sheetstock of paper serving as a carrier to allow the form to be imaged in the printer. Tipped on plastic cards are usually approximately 0.010 of an inch of solid plastic that is expensive and uses petroleum based plastic. Tipped on plastic cards also contribute more plastic to the solid waste stream which is difficult to decompose. Some tipped on plastic cards have inks printed on top of the plastic material for graphics that can often be scratched off with use due to no plastic protective coatings of the inks. Tipped on cards were difficult if not impossible to run through cut sheet laser printers because of unequal thickness and non-coplanar surfaces.

Previous tipped-on cards are adhered to a moving web of paper with a mechanical "tipping on" process during manufacture that can cause the cards to not be adhered exactly in the position desired. This can cause the data that is imaged on the form to be skewed in a position that is undesirable. Also, it is possible the tipping-on process can be much slower to manufacture than the inventor's process as tipping is slow and printing cards and carrier sheets must be printed independently and adhered together in a separate operation.

It has been found that a sheet of flat paper bearing a plastic coated section with the plastic being of sufficient thickness to create a relatively stiff, durable card and shrink-resistant from the high heat of the laser printer with the die-cut cards will not properly feed in many printers. The paper feeding, paper transport, fusing systems, imaging systems, paper output and input and timing registration devices in many laser printers are extremely sensitive to variations in thickness and weight distribution of paper or plastic sheets. When a sheet of paper having a plastic-coated section with the plastic being of sufficient thickness to create a durable card and resist shrinking from the high heat of the laser printer is to be fed into a laser printer, the paper feeding and imaging process falls out of alignment, causing many of the images on the sheets to be misaligned and poorly imaged by the laser printer. In addition, the paper may jam in the machine and in the output hopper.

Full coated or laminated sheetstock made entirely or substantially with plastic on areas other than the card are environmentally wasteful, cost more and cause greater recycling problems, and are difficult to fold and insert.

Previous labels include those commonly known in the industry where a paper or plastic material is adhered on top of a similar sized material with a combination of layers of barrier coating such as a silicone release liner, and adhesives between the two materials After "kiss" die cutting, the label may be shaped and it can be peeled away from the release liner. Most labels of this type require that two equal sized full sheets of material be used which may be environmentally wasteful and expensive, in particular if the application does not require a full sheet of label material. There are also labels that are adhered on top of one portion to another sheet. There is also a "patching process" where the release liner or label is applied to a moving web with affixing equipment and then die-cut to the shape desired. The advantage of this patching product is the label and its release liner can be limited only to the area of the form desired for the label. However, as discussed earlier in this patent application, attaching materials to the top portion of a flat sheet of paper of greater surface area causes a thickness build up of the sheetstock and a stack of sheetstock creating the problems previously discussed when going through various printers.

Previous methods for producing printed laminated tab cut index tabs included a method where a sheet of paper is printed and then a piece of plastic is then wrapped around the printed area and tab cut to the desired size as often used for a catalog or price book pages. Such product often required a two-step process where the sheet of paper was printed with traditional litho or flexo process and then run in tabbing equipment commonly available for tab cutting and adding plastic over the paper. This two step process could be an expensive process—especially in low quantities as set up charges for printing and laminating are expensive. Other problems with this process include potential slow turn around time, companies having to hire an outside vendor to perform the custom printing and laminating, and many additional costs such as potential obsolete inventory expense for out dated index tabs. The process to make print, laminate and cut the tabs to the desired shape could also be slow. In addition, it would be difficult to image with a computerized printer the balance of the sheet that is not the tab in laser printers or photocopiers because of the thickness buildup already discussed.

Another process for making printed index tabs was to print separate labels and affix them by hand to a tab cut sheet of paper. Such labels are slow to apply and may not wrap all the way around the sheet of paper allowing for potential frayed edges and the label to come off.

Previous methods for two way envelope mailer forms include sheetstocks of paper with one sheet of paper have an additional sheet of paper or plastic of lesser size adhered on top of a portion of it to form a pocket which creates a return envelope such as those made by the Transkrit Corporation and others. There is also a product featuring two sheets of substantially equal size paper being adhered together on top of a portion of the three sides of the sheetstocks to form a pocket creating an extra extended sheet above the envelope flap such as those made by the GlueFold Corporation.

Sheetstock with one sheet of paper having an additional paper of lesser size adhered on top of a portion of it do not feed well through a non-impact printer and do not stack evenly when stacked in a pad placed one on top of the next as in a infeed hopper in many Xerox brand laser printers and most other printers or when placed in a shipping carton due to the uneven thickness of the form as previously described in this patent. Return envelope mailers with two equal sized sheets adhered on a portion of three sides may be awkward to open by the recipient, more expensive to produce because of slow press speeds and the difficulty of printing and gluing together in line in one pass, more paper may be used than is necessary to communicate the sender's information which is also environmentally wasteful, having a second sheet of paper can create confusion for the recipient trying to determine how to use the form, and the form can also create folding problems in machinery due to having to fold two sheets of paper in a "c fold" which causes the outside sheet to stretch a longer distance than the inside sheet and the inside sheet may also become wrinkled. This stretching and wrinkling can look aesthetically unattractive and damage the form and the data imaged on the sheet as the toner can chip off the paper when the paper is stretched or wrinkled.

Many companies wish to send outgoing mailers capable of including a built-in return envelope and an outgoing form with or without data imaged on it and optionally a return remittance form with or without data on it using various computerized imaging technologies already mentioned. They also wish to avoid the waste and expense of buying and storing outgoing and return envelopes, having to match and insert personalized and non-personalized documents with traditional inserting equipment and wish to use as little paper as possible in their mailings due to expense and environmental waste. Because many dot matrix impact and non-impact printers can image high quality graphics, variable data text, and bar codes the user can order non-printed forms from the manufacturer and add the graphics desired with their own computerized imaging equipment and also add a Post Net bar code to both the outgoing and return address areas that reduces their mailing costs from the U.S. Postal Service and speeds mail delivery.

Some companies may wish to have the envelope be translucent on one or optionally two sides, as an example a photo laboratory that wishes to put negatives inside an envelope but must be able to see the contents inside the envelope, or a jeweler wishing to do the same, or for a ring binder insert sheet for use in a presentation.

Many hospitals and nursing homes wish to have wrist bands that can be imaged with high quality graphics, text and bar codes for easier identification. In addition, many airports wish to have a closed loop identification band that can be personalized by a laser printer and then adhered to itself or have a hole punched in it so that it can have a string placed through the hole to create a tag. Presently, no sheetstock is available that allows for an inexpensive means to produce such a wrist band or closed loop band in a table top laser printer.

SUMMARY OF THE INVENTION

The inventor's solution to the vexing problems of providing sheetstock that can be readily manufactured efficiently and processed in various types of high quality marking equipment, such as those previously described, and inserting machinery and can also be readily separable from a core sheet so that the composite is constructed for the application in mind is to provide various attachment means for two or more materials of non-equal size so that the two or more materials of unequal size forming the sheetstock have coplanar surfaces or functionally equivalent thicknesses and a also a means of constructing the composites and separating the desired portion of the composite laminate from the sheetstock and for the application desired.

The inventor's constructions thus provides a solution to a variety problems that is preferable to those products previously available for the following reasons. The inventors card or other composites is often more thin, only 9.3 mils of and inch, but made from a composite construction of adhesives and laminates adhered in varying ways that provides more strength than many cards made from 7 to 10 mils of an inch of solid plastic, the cards are environmentally preferable and lower cost as only 2 mils of plastic may be used compared to 7 or 10 mils, the printing is protected by a plastic layer, the card can have a high quality machine readable image made on it, the cards can be adhered to a carrier sheet accurately and fast, the card and carrier form can be printed and adhered together forming the sheetstock in one pass of a press, the forms stack evenly when placed in a pad one on top of another or when wound in a roll or placed in a carton, the personalized sheetstock can be placed in one tray of a multiple tray imaging or inserting machine allowing the sheet stock to be imaged, matched and collated with other documents in the same print stream using an automated means, the cards do not fall off of the carriers due to the unique coplanar or functionally equivalent thickness that do not snag in the printers, the grain direction of the finished sheetstock may be short grain which allows for easier folding and handling in inserting equipment, having as little laminated material on the sheetstock as possibly may reduce the mailing weight and cost of the sheetstock, less sheetstock bulk allows for more forms to be processed in a computer printer or inserter longer before having to reload the machine and also provides savings in storage and shipping, envelopes and traditional inserting may be eliminated by folding the form and sealing it to create as self-mailer, high quality bar codes, graphics, text and pictures can now be imaged on the entire sheetstock possibly reducing or eliminating the need for custom printing by an outside printer, low cost personalized paper letters can be easily attached to the laminated material desiring to be distributed, and the laminate is readily separable from the sheetstock and designed for the application in mind.

The invention is directed to sheetstock that employ laminates added to a core sheet material with either one or more scab sheets superimposed on the top of the core sheet to offset the difference in thickness of a laminate providing functionally equivalent thicknesses or indented regions with laminates, adhesives, release coatings and separation aids in the recessed area which makes the sheetstock coplanar and provides an excellent flat surface to image by various imaging systems. The invention allows for the use of plastic and paper composites that can be imaged with a wide variety of imaging equipment.

If the sheet is not entirely of one thickness it has been found that laser printers allow various non-coplanar materials to feed successfully if they are substantially of uniform thickness and there is an area that acts as a hinge to allow the paper to adjust in the printer.

In addition to keeping the sheet stock flat for printer performance there are other benefits to keeping the sheet flat. If a thickness build up is allowed due to uneven thicknesses on a sheet when stacked in a pad as is common with fan folded continuous forms or cut sheet forms, the individual sheets may develop a curved memory as the adhesive sets up and moisture and weight effects the paper stock while it is stacked on top of itself. This curled "memory" in the sheet can cause problems in feeding, imaging, output, and inserting in addition to being unattractive to the end recipient. In addition, many companies desire to wind paper webs into large rolls to get longer run time than fan folded forms in cartons in their computer printer that increases throughput per unit of time and reduces labor costs. Forms of uneven thickness would "telescope" if wound on a roll and thus cause handling problems whereas a sheet stock of coplanar surfaces would lay even when wound on a roll.

It has also been found many of these printers can successfully utilize papers cut short grain even with various adhesives, papers, and plastic laminates adhered to one or both sides even in Xerox brand and other cut sheet laser printer that specify long grain paper when a device called the X4 Transport inside the Xerox 8700 and 9700 family of laser printers is lifted approximately 1/16". This can be done by lifting the X4 Transport and inserting paper or magnets underneath the support posts- holding up the X4 Transport approximately 1/16" from its normal position. In particular, if the laminates are placed in an indented area on one or both sides of the core sheet or an additional material is added to the core sheet to add thickness to the core sheet to make the sheet of uniform thickness. Indenting the paper sheetstock underneath where the various laminates are adhered also makes the sheet slightly more flexible because the laminates have to bend a shorter distance around the core sheet in that area than if the core sheet were not compressed so that the compressed paper with laminates in the recessions is capable of bending and adapting to the pressure rollers found in many printers. The pressure placed on the paper fibers breaks the paper fibers making that area become less stiff than it were had not been compressed.

It has been found that the addition of plastic in an indented region on only one side of sheetstock may increase the tendency of the sheet to curl in a heat intensive printing process. This can cause problems such as jams in equipment, aesthetic problems, and low bar code read-rates in slot scanners. However, if a similar matching layer is added to the bottom side of the sheet, the sheet processes through the heat intensive device with less curl as the additional laminate may reinforce the sheet stock and counteract any shrinking or curling. Additionally, if the sheet with plastic on both sides is run through the printer in duplex mode to print on both sides of the sheetstock, shrinkage is equalized on both sides negating any curling tendency.

The inventor's solution may use plastic only 0.00092 of an inch thick of plastic adhered on one or both sides of a compressed paper core forming a composite whereas many tipped-on plastic cards utilize a card 0.01 inches thick.

It must be remembered that "readily separable" means any means used to weaken a material so that it can be detached from itself more easily. This may include a series of cuts and ties through a stock often called perforations, a continuous cut through a material from one or optional two sides that goes partially through the material or up to an adjacent material as is commonly called kiss-cutting, weakening the material from one or both sides by applying pressure to the sheet which is often called scoring, use of what is called a micro perforation, or it may mean release coating are added between adhesives and the core sheetstock to facilitate easy peeling from the sheetstock, or any other means of weakening a sheetstock so it is more separable.

It must also be remembered that the terms layers or laminates can also mean liquid coatings that may be applied to a material that will form a layer.

For purposes of description herein, if the scab sheet is superimposed on the first sheet functionally equivalent thickness is obtained when the upper surface of the second sheet is substantially coplanar with the exposed upper surface of the scab or second sheet. Thus, for purposes of this description, the upper surface of a scab sheet which superimposed on and therefore integral with, a first or core sheet, will be considered the upper surface of that first or core sheet.

The invention provides a blank or custom printed paper tab cut form where the paper in the tab cut area is compressed so that when a toner receptive plastic is adhered over the top of it the form maintains a flat coplanar profile with the balance of the form. This combination laminated and tab cut form will then be able to be imprinted with traditional photocopiers or laser printers on the entire sheetstock. Thus, companies can order an inexpensive precut and laminated form and print the data on top of the toner receptive coating on the plastic to provide fast and inexpensive means to print information in the tab or remaining area in-house. Small quantities will be less expensive to produce, waiting for vendors to print custom jobs will be eliminated, and obsolete inventory will be reduced.

One way to make coplanar sheetstock for identification cards and the like is as follows. The sheetstock bearing identification cards are formed by adhering a first "core sheet" of paper to a plastic of lesser surface area than the core sheet which forms a composite. Conventional die-cuts are cut through the layers of the sheetstock to form one or more identification cards or tipped-on plastic layers that allow a user to remove the cards from the sheet when desired are added. The remainder of the sheet is substantially covered with a second layer or scab sheet layer of paper or other sheetstock in that area to increase the thickness of the sheet to that approximating the thickness of the plastic-coated portion to create a functionally equivalent thickness sheetstock. If plastic is applied to both sides, a space of at least about 1/16" between the plastic coated portion and the second paper layer coated portion may act as a hinge to allow the sheet to feed and travel through the printer evenly. This second layer makes a stack of such sheets feed smoothly into and through laser printers without jams, misalignments or poor imaging. The second layer also makes the paper more level and even when stacked in the laser printer's in-feed and out-feed hoppers and in shipping and storage. The space left between the plastic and second layer ensures this uniform feeding by hinging the sheet even when a plastic coating is placed on the bottom as well as the top of a portion of the sheets. The paper sheet effectively flexes to maintain a flat profile with functionally equivalent thicknesses through a printer even though the sheet may not be coplanar.

The recessed form of the invention provides the same benefits by equalizing the thickness of the sheetstock by indenting (compressing) the paper and plastic layers so that the sheet is coplanar or functionally coplanar.

The inventor has also developed various types of labels and a method in which the imaging equipment previously described, can rapidly produce paper or plastic labels that can be popped out of, peeled from, or torn away from a paper letter format. A plain sheetstock of paper is used as the "core" to which laser printable plastic, plastic or paper may be applied to the front and optionally the back over a portion of a paper sheetstock that is recessed in the area(s) to which laminates, coatings and adhesives are attached to it sufficient to form the number of labels desired.

The paper or plastic desired to be used as a label(s) is peeled away from the release liner with the adhesive attached to the label in the area the material has been compressed into the paper sheetstock or, optionally, shaped by conventional die-cuts which allows a user to peel the labels from the sheetstock in the area outlined by the die-cut when desired similar to ordinary labels. The die-cuts are generally not a series of cuts and ties as the identification cards but one continuous cut in the shape of the label desired. The layer of material that is desired to be removed and used as a label is die-cut through the material and the adhesive up to the release liner as is commonly known in the trade as "kiss cutting" allowing the adhesive on the material to stay with the material forming a label.

Applications where the labels may be used include mailings where a personalized but clear plastic label combined to a paper sheetstock mailer desires to be mailed such as a renewal license to be placed inside or outside of a car window, or a "yes no label" often used for direct mail solicitations, or plastic or combination paper and plastic name tag stickers that are to be mailed to convention show attenders that can be adhered to a persons clothing.

The inventor has also developed a label which can serve as a closed loop wrist band or label or can have a hole cut into it to allow for a string to be placed through the hole to make a tag. A layer or release material can be placed between the laminates and a die-cut can be kiss cut through one or optionally two laminates to allow the protective layer to be removed to allow the adhesive to be exposed The inventor has also developed return envelope mailed and a method in which computerized printers such as those previously described can rapidly personalize with text, graphics and bar codes two-way envelope forms that can then be processed for mailing in existing folding and gluing equipment such as those machines sold by GlueFold Corporation, Standard Register and the GBR Corporation. These machines will add adhesive to the edges of the form, perforate the edge(s) and fold the form in half or thirds or other configurations. This folding and sealing create additional confidentiality to the information imaged on the form and allow it to be mailed efficiently. Optionally, the forms may be folded and sealed on one side by tabbing machines as sold by Rena Systems Inc., where the document is folded and then a tab or label is affixed around the edges sealing the document on one side.

This return envelope form also reduces the need for buying and storing outgoing and return envelopes and separate forms, the costs and hassles of using traditional inserting machines and potential problems of matching personalized forms and envelopes to each other, and reduces the need for excess paper usage, thus, saving trees and the chemicals required to make paper including petroleum. This return envelope form also reduces unnecessary solid waste pollution.

It has been found that a sheet of paper having an additional sheet of paper with lesser sure are adhered on top of it such as to form a return envelope will not feed properly in many printers due to the reasons already mentioned in this application about problems feeding sheetstock of unequal thicknesses or non-coplanar surfaces.

When a core sheet of paper is indented having an additional sheet adhered to its indented portion or both sheets are crushed to form a sheetstock of uniform thickness the form may image and feed well. A plain sheet of paper is utilized as the "core sheet." This core sheet stock is indented in an area to which a "scab sheet" of paper or plastic or printable plastic sheetstock is adhered to it on three continuous sides thus forming an envelope pouch or pocket. Rewettable or other adhesives may be added to a portion of the core sheet to form the envelope pouch on the side where there is no other permanent adhesive forming the envelope pouch to allow for applying moisture or other activation means to it which can activate the glue so that this flap portion can be folded and sealed over the scab sheet to seal the fourth edge of the scab sheet forming a sealed envelope. It would also be possible that the adhesive could be on the inside of the envelope so that there is no portion to be folded over and sealed. It would also be possible that the envelope flap sealing adhesive could be added to the inside of a scab sheet flap so that the printer is never exposed to the adhesive. Another alternative to rewettable adhesive is a strip of transfer tape that can be applied as is common in the forms industry that can be peeled away which exposes the adhesive and allows for sealing of the envelope. This transfer tape can create an additional thickness to the form so it is important that this tape be adhered to the core sheet or laminate in an area where it has been indented. A perforation or score is placed in the core sheet above the adhesive to allow for the recipient to easily detach the envelope from the core sheet so that the recipient of the mailed sheetstock form can mail the envelope back to the original sender. Additional perforations, or other means of separation, may be placed in the core sheet such as to allow for the envelope flap to be more easily folded back onto the envelope for sealing and also so that the recipient can easily tear off and separate the envelope or other portions from the remainder of the core sheet in order to allow the recipient of the mailing to return the envelope and keep a portion of the form for a record and to remit with the balance of the core sheet so that the recipient can communicate to the sender as in the case of receiving proper credit for a payment for a bill.

This form can be imaged on both sides if the non-impact printer can image in a "duplex" fashion. However, some companies pay a "click charge" to the laser printer manufacturer; as an example Xerox Corporation, for each sheet imaged that passes through its printer. To eliminate this cost, or improve speed, a hole can be die cut through the core sheet to allow for information, such as the outgoing address, to be read from the outside of the folded and sealed document so that the mailer does not need to image on both sides of the two-way envelope mailer form. This die-cut hole can be left open, or, an additional sheet of translucent plastic or paper such as glassine or polyester can be adhered to an indented edge of the die cut hole to protect the contents, reduce snags in imaging and mailing equipment and add confidentiality to the mail piece. To eliminate the possibility of a thickness build up where the translucent window has been adhered to the core sheet it may be important to indent the core paper surrounding the window hole so that when the translucent paper or plastic film is adhered to the core sheet around the edge of the die-cut hole the additional thickness of these materials and the adhesive is negated thus keeping the core sheet stock flat and coplanar and allowing it to stack evenly and feed through the printer and mailing equipment easily.

BRIEF DESCRIPTION OF THE DRAWINGS

A detailed description of the invention is hereafter described with specific reference being made to the drawings in which:

FIG. 17 is a bottom view of a page of sheet stock showing where an additional release liner of paper or plastic is needed on the bottom to be kiss cut up to;

FIG. 20 is a cross-sectional view of the page of FIG. 17 showing where an additional release liner of paper or plastic is needed on the bottom to be kiss cut up to;

DESCRIPTION OF THE PREFERRED EMBODIMENTS

Id Cards

Example 1

Figure 1:
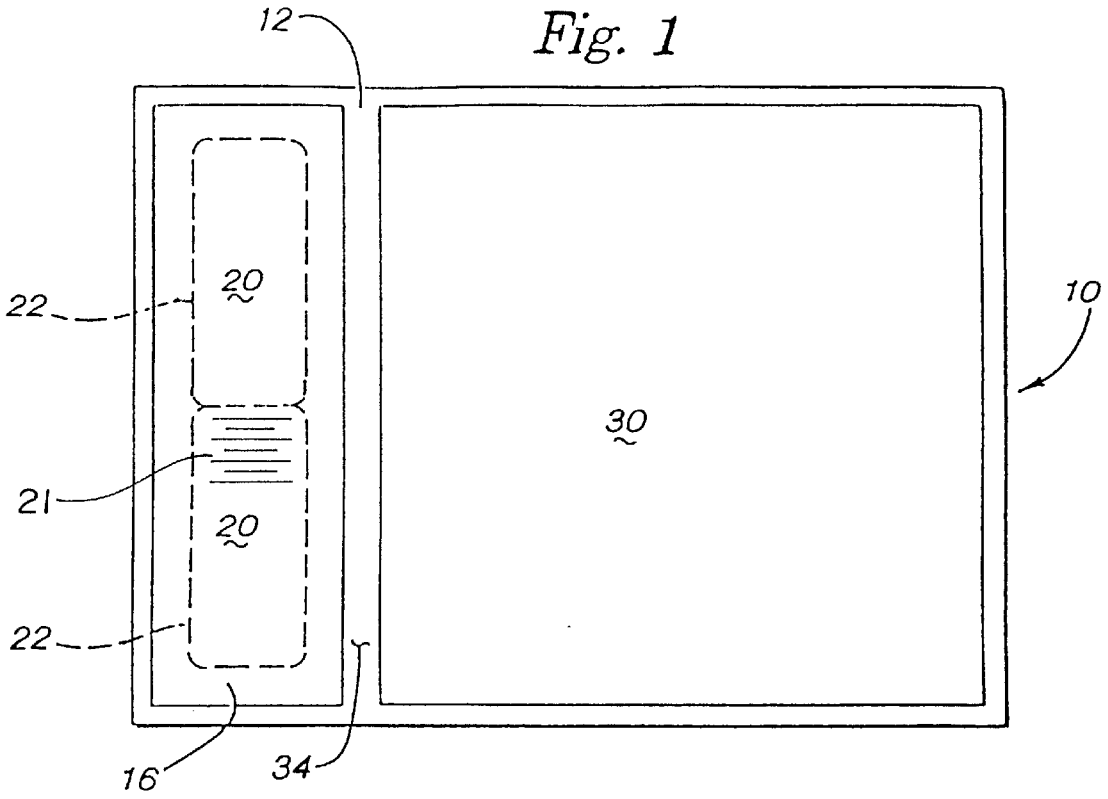
FIG. 1 is a top view of a page of sheetstock bearing text and die-cut identification cards having a scab sheet.
Figure 3:
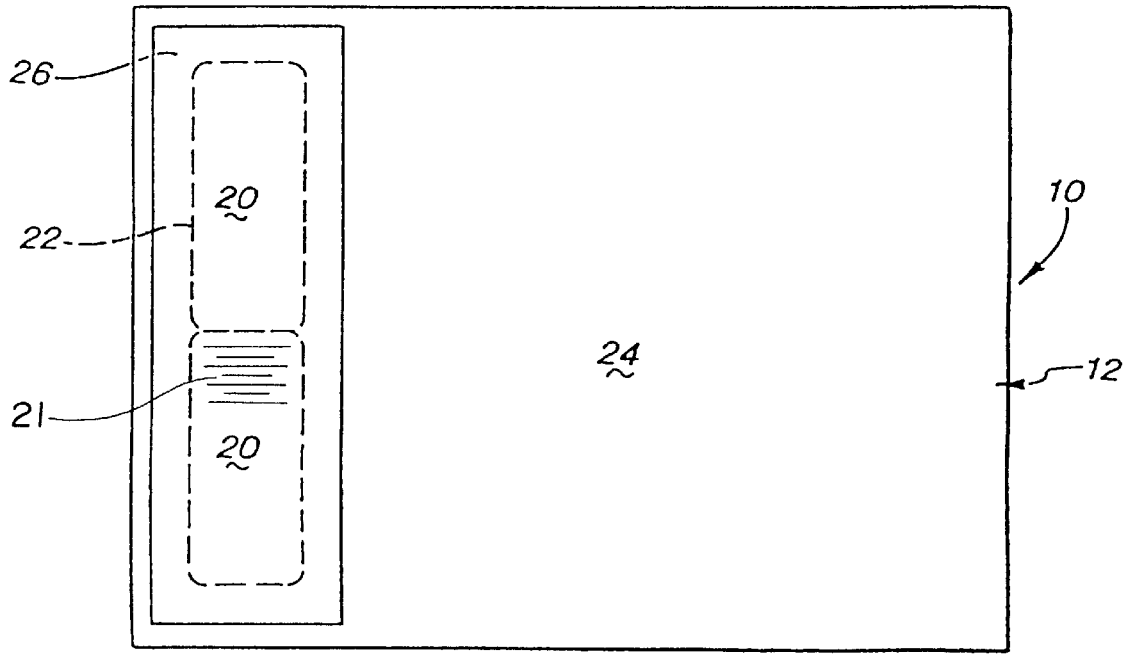
FIG. 3 is a bottom view of the sheetstock of FIG. 1.

With reference to the Figures it will be seen that sheetstock 10 is formed from a page of paper 12 to which a top layer of plastic 16 is laminated or otherwise adhered by adhesive 18. Plastic layer 16 is fabricated from the plastic and optionally coatings that are currently in use in laser, impact ink jet or thermal printing. Such plastics or other coatings must facilitate and accept the transfer and adhesion of laser imaging toners or other types of inks, toners or materials used to mark the sheets by the various types of image transferring systems found in the printer being used. Since such applications may involve substantial heat of 400 degrees Fahrenheit or more, these plastics are quite heat resistant. A suitable plastic and coating is available from Dunmore Corporation of Newtown, Pa. marketed under the designations Dun-Kote DK Clear CITC ng02-17-04. Low static plastics and coatings are desirable. If cold fusion laser printers, ionographic printers, inkjet printers or impact printers are to be used, the constraints on the plastic types and coatings will vary.

Identification cards 20 are formed in the plastic/paper composite by die cutting the sheetstock. Such die cuts 22 are well known and include a combination of ties and slits that allow the card 20 to remain together and affixed to the sheetstock through identification card production and laser printing equipment until the recipient pops it out of the sheet. The position of the cards, die cuts and ties may vary depending upon the desires of the end user and application and the ability of the each configuration to run through the printer. For die cut cards that are placed on a portrait oriented form with the cards die cut in a landscape direction that will be imaged in a Xerox 9790 laser printer the ties of the die cut should be approximately 1/32 of an inch long. There should be nine (9) ties on the vertical perforations and twelve (12) ties on the horizontal perforations. The slits completely penetrate all layers of the composite. To keep the card in place and from popping out in the laser printer, ties should be left at all corners. Continuous forms that need to be burst with traditional bursting equipment may need special attention to the fanfold perforations. These perforations may need to be cut with a bi-level die so that the plastic is cut entirely across the form but the paper ties remain in place to hold the form together. Alternatively, the plastic may be tipped on in exactly the required size, eliminating the need to die cut the plastic when on the substrate paper. The excess plastic around the die cuts may be peeled away if desired, such as with mailing label sheetstock. Also, it may be of value to use a bi-level die to insure the plastic is cut around the cards for easy removal but the paper ties remain in place. The plastic laminate would be kiss cut around the paper to the edge of the plastic.

The cards to be formed are preferably plastic on both sides to provide a better looking and longer lasting ID card. The back 24 of sheetstock 10 may include a bottom layer of plastic 26 laminated or adhered by adhesive 28 to paper 12 as with the front layer 16. The top or bottom layer need not be laser printable plastic if the information is already printed on that sheet (as in the case of unchanging information about the supplier). It has been found that a sheet constructed as described above will not work satisfactorily in many laser, ionographic or ink jet printers. The papers may not be fed into or be transported through the printers properly. The paper may also be slightly out of alignment when travelling through the printer which causes jams and imaging of the cards created to be imperfect at the least and possibly unusable. The sheetstock must include a second layer of paper 30 (or other sheetstock such as a pressure sensitive label stock material) adhered with adhesive 32 (or other attachment means) to page 12 as shown in the Figures. This second sheet of paper or plastic is applied over substantially the entire surface of page 12 with the exception of gap 34 that is not covered with plastic 16. This top paper layer 30 could readily accept any laser printing and causes the sheetstock to feed evenly into, through and out of the laser printer. Example 6 describes a form of the invention using similar principles in which recessed paper is employed instead of two layers of paper.

If a second layer of plastic 26 is present on back 24, a gap or space 34 is preferably maintained between top paper 30 and plastic 16. This gap makes the sheetstock slightly more flexible at that point and functions as a hinge to keep the paper flatter as it travels through the laser printer's infeed device, paper transport, output systems, imaging and fusing systems. Also, a means of weakening and flexing the sheetstock such as perforations or scoring could also be added in this area This allows the paper to flex slightly and to compensate for the fact that the plastic 26 on the back 24 makes the sheet uneven. This allows the plastics and paper to have space to move freely, independently so that they don't snag each other as the paper shifts when it is struck by fusing and imaging rollers of the printer. However, the thickness of the top paper 30 is selected such that the thickness though the entire sheetstock through paper 30, adhesive 32 and page 12 is functionally equivalent to the combined thickness of the page 12 and plastics 16 and 26 together with the adhesives. When so constructed, the sheetstock will feed smoothly, stack evenly and print properly in a laser printer.

When the paper and plastic layers are thinner, there is less need for a gap. As the plastic layer becomes thinner, only the separation line may be required. Instead, the mere break line between the second sheet 30 and the plastic 16 may be sufficient. The gap or space 34 must be at least about one-sixteenth of an inch (1/16) and preferably at least about 1/8" to 1/4" to allow this flexibility with thicker paper and plastics. The second sheet of paper 30 compensates for the presence of the plastic layer on an end of the sheet by equalizing the thickness and re-balancing the sheetstock. The internal synchronization systems of the laser printers work well when the paper sheet is added to balance the weight distribution and to equalize the thickness of the sheetstock. Generally, the more of the surface of the page 12 is covered by second paper 30 the better, with the exception of the need for space 34.

Example 2

Figure 6:
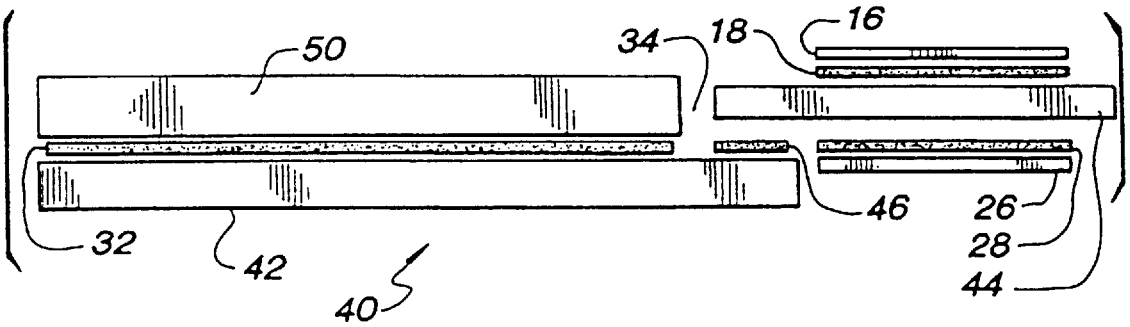
FIG. 6 is a cross-sectional view of the embodiment of FIG. 5.
Figure 5:
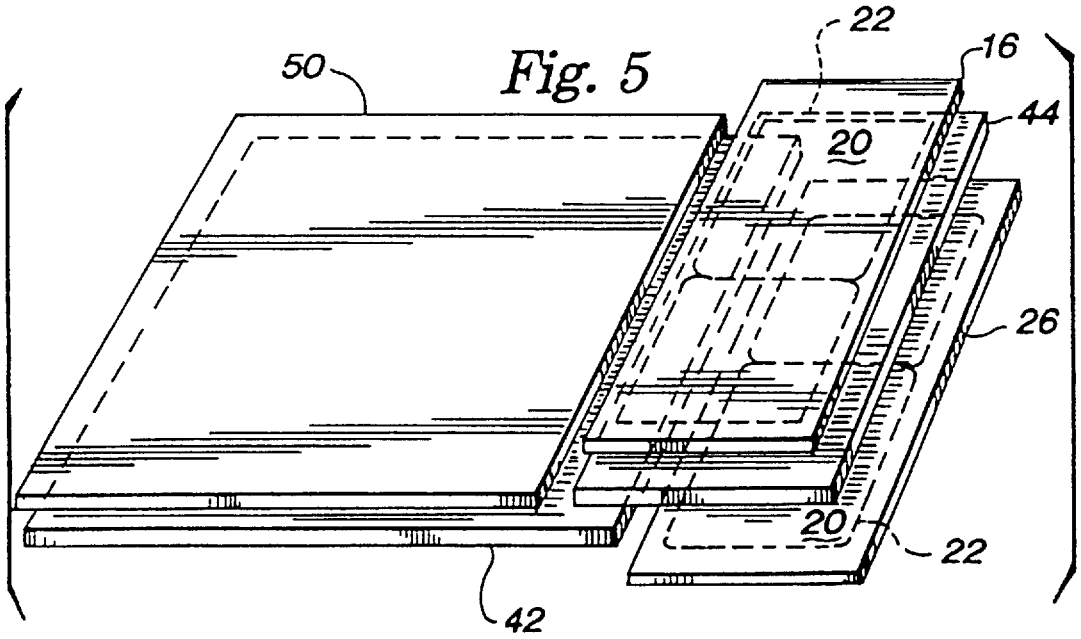
FIG. 5 is an exploded view of an alternate embodiment in which the main sheet does not extend the full length.

The advantages and benefits of the invention may also be realized with the alternate constructions shown in FIGS. 5 and 6. With reference to the figures it will be seen that sheetstock 40 includes a paper or plastic layer 42 which unlike sheetstock 12 does not extend the full length of the completed article. Instead, the sheetstock 40 is formed by attaching a second layer 44 to layer 42 by adhesive 46. The top plastic 16 and bottom plastic 26 are attached to layer 44 with adhesive 18, 28 respectively.

The use of a second layer 44 to complete the length may reduce or eliminate the need for any gap 34 between the scab sheet 50. Layer 44 may be thinner than layer 42 such that the overall thickness of the sheetstock 40 is nearly identical or functionally equivalent across the entire sheet. Layer 44 may be plastic or paper. Also, the profile in cross-section may be such that the exposed surface of layer 42 and layer 26 are nearly co-planar. This prevents the problems described previously with feeders in laser, ionographic and ink jet printers. No gap would be needed if the outside surfaces of the sheetstock are nearly coplanar.

The construction shown in FIGS. 5 and 6 would probably require running two webs of paper/plastic through a rotary press. The layer 42 would be adhered to layer 44 during such a run. The plastic layers 16 and 26 could then be added as desired by unwinding and adhering one or more paper or plastic layers onto layer 44. Die cuts 22 to form cards 20 would also need to be added. Scab sheet 50 could be attached with releasable or non-releasable adhesives in the same or in a separate run. It may include a release liner and die cuts as is known in the art to allow release of all or a portion of layer 50 later to be used as a label.

Example 3

Figure 8:
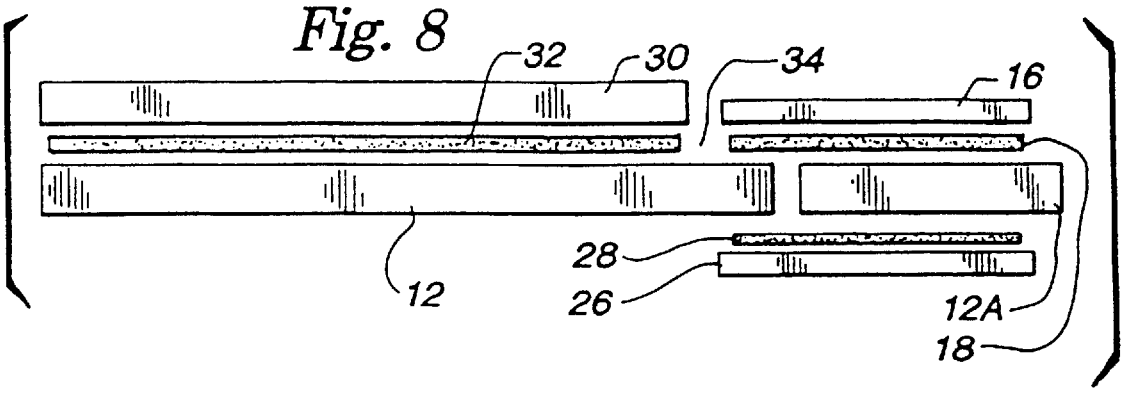
FIG. 8 is a cross-sectional view of the embodiment of FIG. 7.
Figure 7:
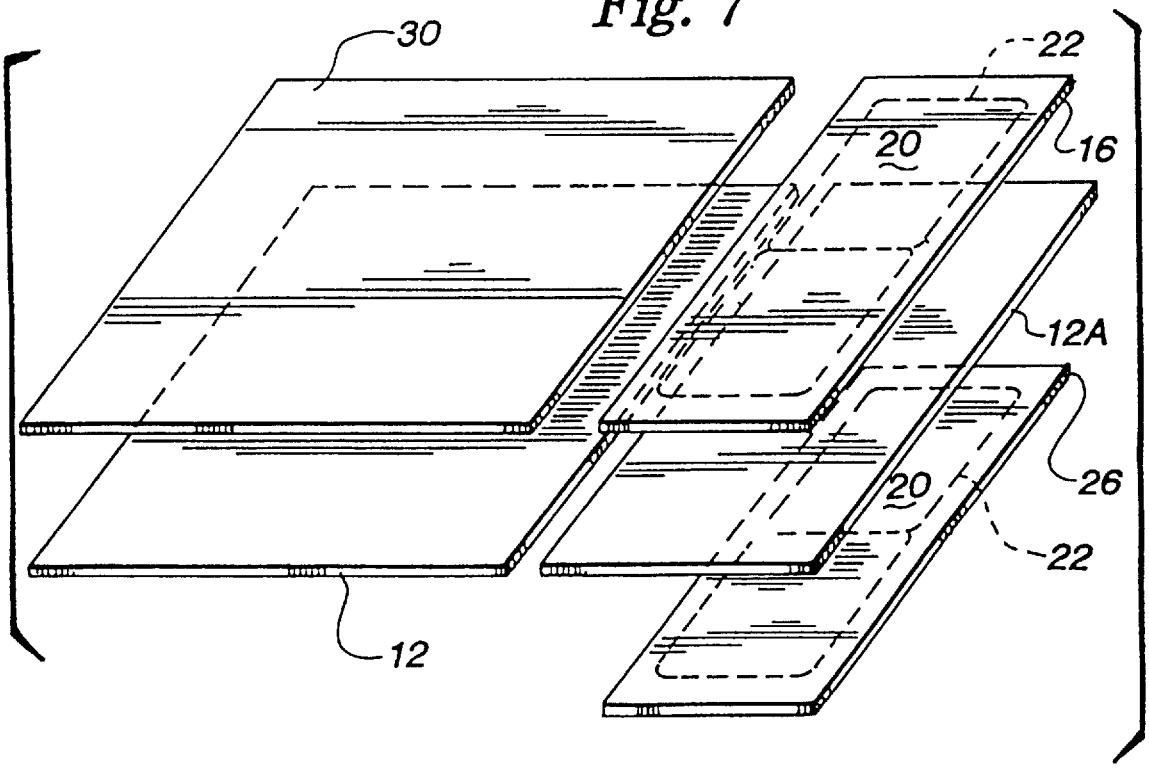
FIG. 7 is an exploded view of a second alternate embodiment in which the main sheet does not extend the full length.

Another embodiment of the invention is shown in FIGS. 7 and 8. The construction of the sheetstock of FIGS. 7 and 8 employs a twin web gluing process such as in FIGS. 5 and 6. However, rather than overlapping the sheets, it is possible to adhere them together by the adhesive and plastic layers. As shown, layer 12 is broken into two parts, 12 and 12A. They may be of the same material and thickness or may vary. Layer 12A may be paper or plastic.

Layers 12, 12A are held together by the adhesive connection formed by adhering plastic layers 16, 26 with adhesives 18, 28 to the layers 12, 12A. The overlap of the plastic layers 16 and 26 secures layers 12, 12A together. Like reference numerals are used to identify features described previously.

Example 4

Figure 2:
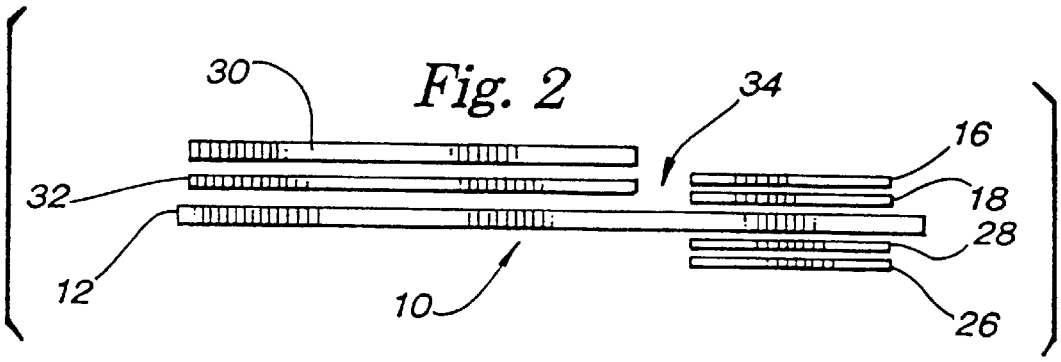
FIG. 2 is a cross-sectional view of the page of FIG. 1.
Figure 4:
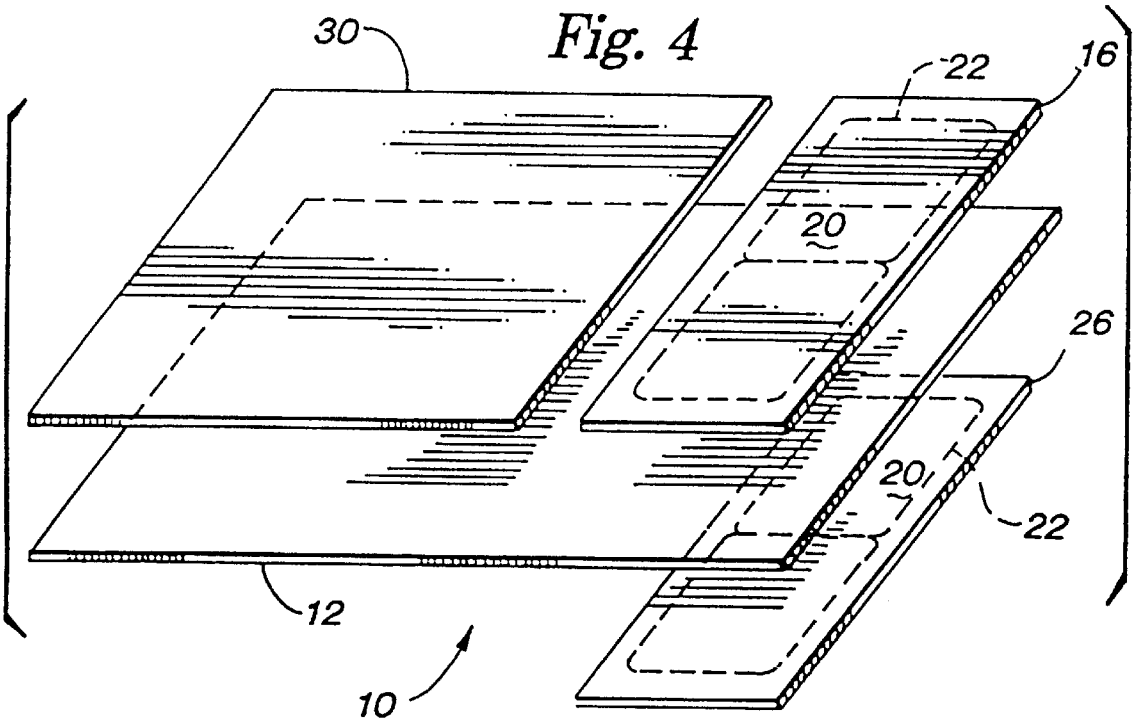
FIG. 4 is an exploded view of the sheetstock of FIG. 1 showing the plastic and paper layers without adhesive being shown.
Figure 10:
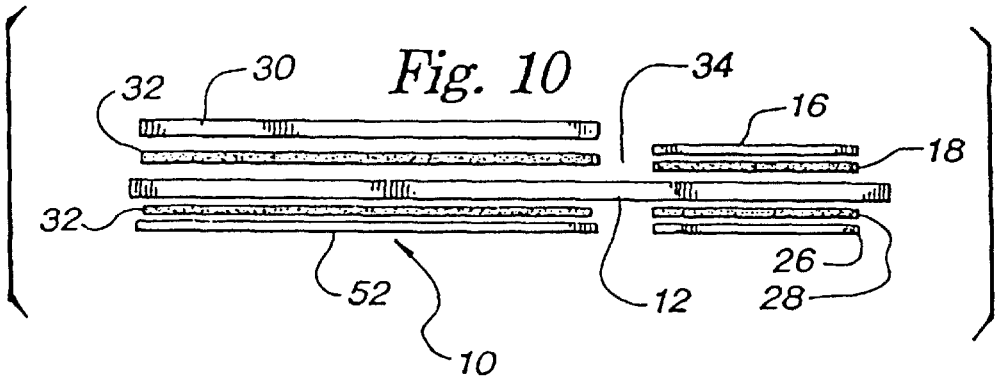
FIG. 10 is a cross-sectional view of the embodiment of FIG. 9.
Figure 9:
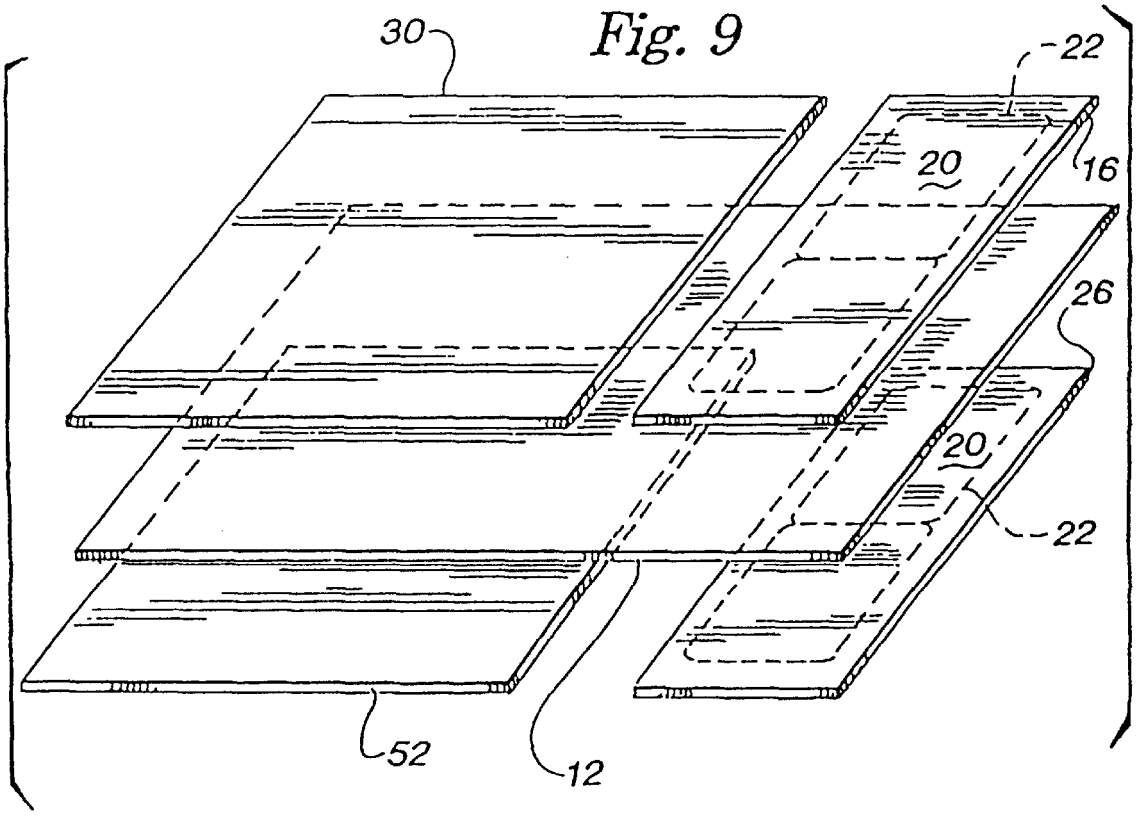
FIG. 9 is an exploded view of a third alternate embodiment in which another scab sheet is added.

The embodiment of FIGS. 9 and 10 is very similar to the embodiment of FIGS. 2 and 4. The embodiment adds a bottom scab sheet 52 in addition to top sheet 30. This bottom scab sheet 52 may be identical to sheet 30 or may be formed from a different material or thickness. It may be adhered with a releasable adhesive or permanent adhesive 32. The addition of the bottom scab sheet makes it possible to make the thickness of the sheetstock 10 through the sheet 30, 52 sections the same as or functionally equivalent through to that through layers 16, 26. More importantly, it makes it possible to present outside surfaces to the sheetstock 10 that are coplanar across the entire surface. This not only eliminates the need for gap 34 but allows the sheetstock to feed well through laser printers.

This form of the invention may require an additional process step to apply sheet 52. However, it may be applied simultaneously with plastic layer 26.

Example 5

Figure 12:
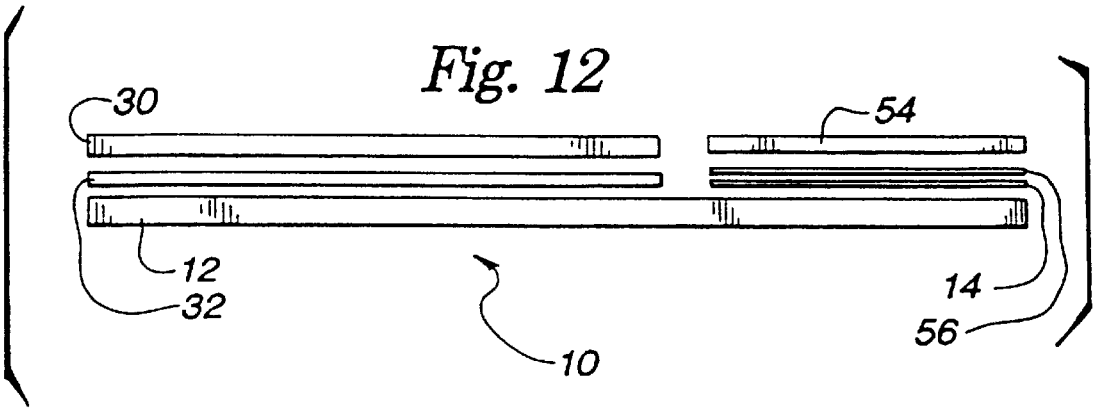
FIG. 12 is a cross-sectional view of the embodiment of FIG. 11 with the addition of a release liner.
Figure 11:
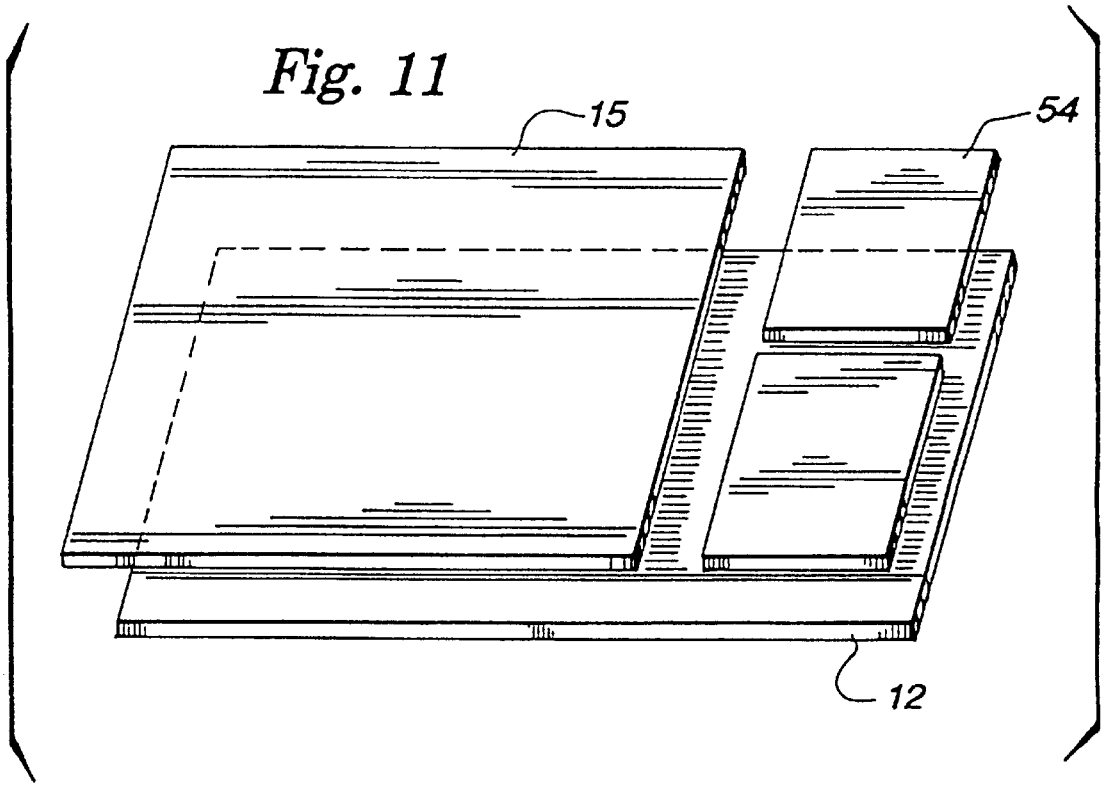
FIG. 11 is an exploded view of a fourth alternate embodiment of the invention in which preformed plastic cards are added.

FIGS. 11 and 12 show that the plastic layers can be applied in the form of cards 54 which are applied to the paper 12 without the need for die cuts in the plastic. Cards 54 to be affixed to the sheetstock may be plastic, paper or a combination of paper and plastic. Preferably, the top layer of the cards 54 would accept laser printing. The cards may be held to paper 12 directly with adhesive 14 or may be adhered to a release liner 56. Release liners may not need adhesive to adhere to paper. Alternatively, the card may include layer 14, 56 and 12 by die cutting layers 14, 56.

Example 6

Figure 14:
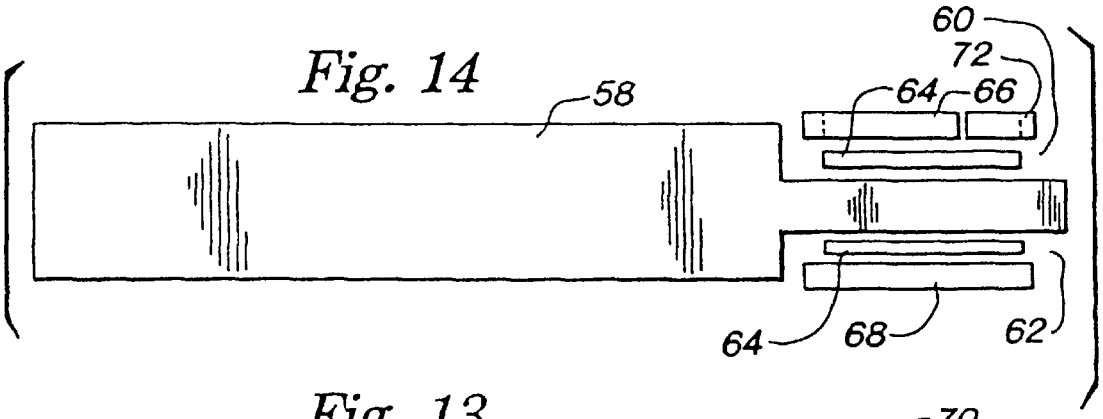
FIG. 14 is a cross-sectional view of the embodiment of FIG. 13.
Figure 13:
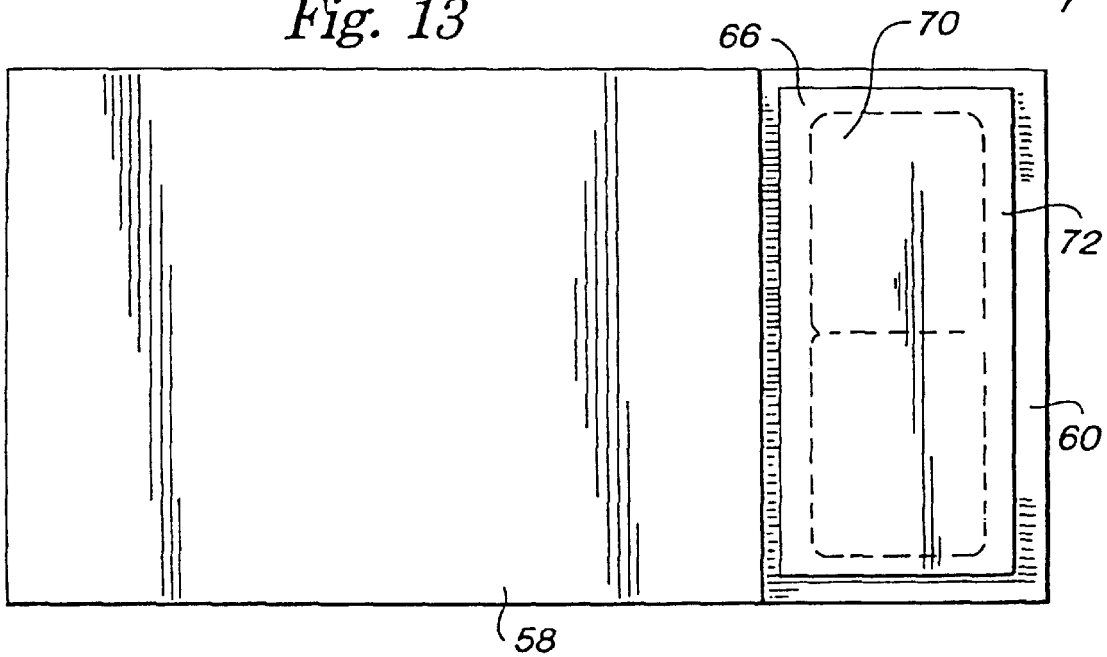
FIG. 13 is a top view of a fifth embodiment of the invention in which the paper is recessed.

FIGS. 13 and 14 show another embodiment of the invention in which the main sheet of paper forming the sheetstock is recessed on one or both sides to form spaces into which the laser-printable plastic may be applied. In this manner, the recesses function in the way that the main sheet and scab sheets function. The recesses allow the finished sheetstock with a core sheetstock of Springhill 110 pound Index and laminates and adhesives added in the thicknesses added in the indented areas to have coplanar surfaces that will feed well through printers. The plastic needs to be fairly thin, approximately 92 gauge, to ensure that the weight distribution is not unduly unbalanced. The recess may be anywhere on the sheetstock. There may be more than one recess on the sheet. Die cuts through the layers will form the completed cards.

Figure 15:
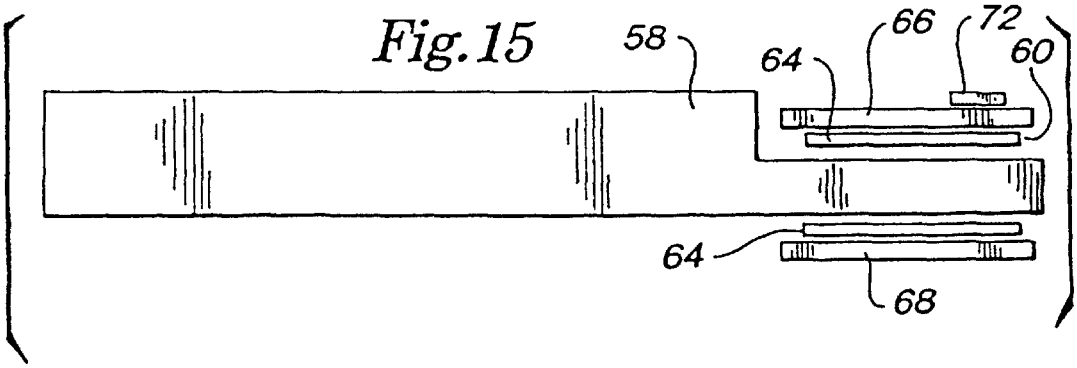
FIG. 15 is a cross-sectional view of an embodiment similar to FIG. 14 except it has no second recess.
Figure 16:
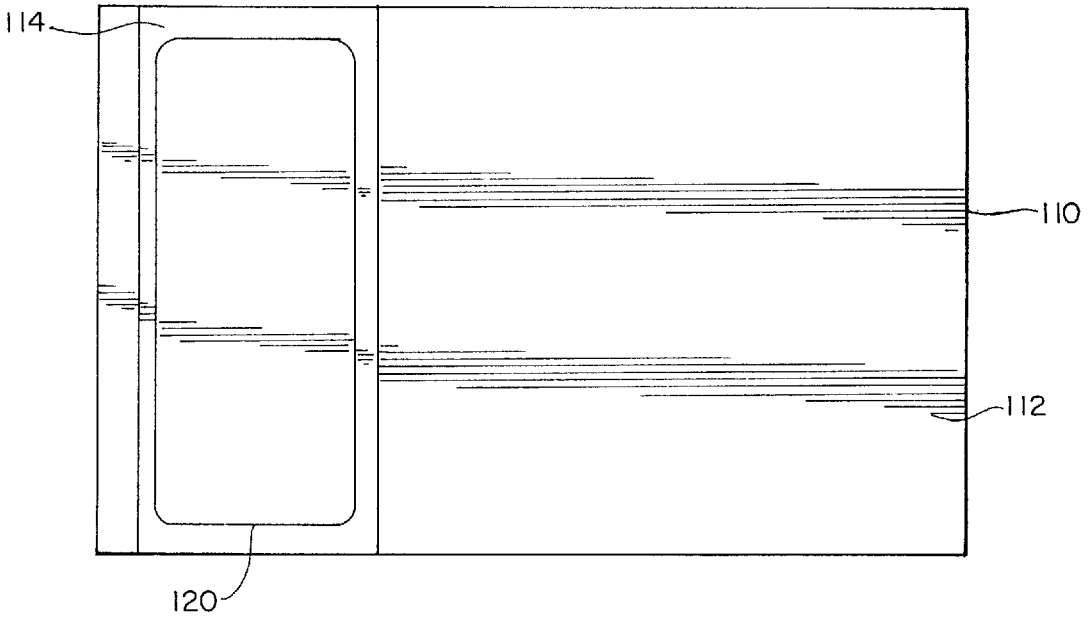
FIG. 16 is a top view of a page of paper sheet stock bearing an additional paper or plastic laminate with die-cuts forming the shape of the desired label.
Figure 17:
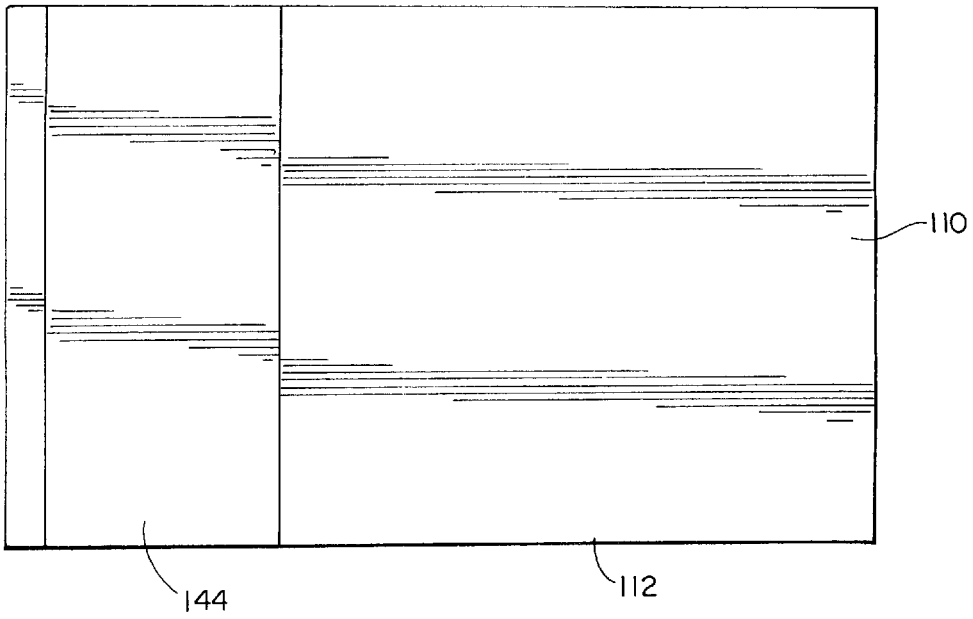
Figure 18:
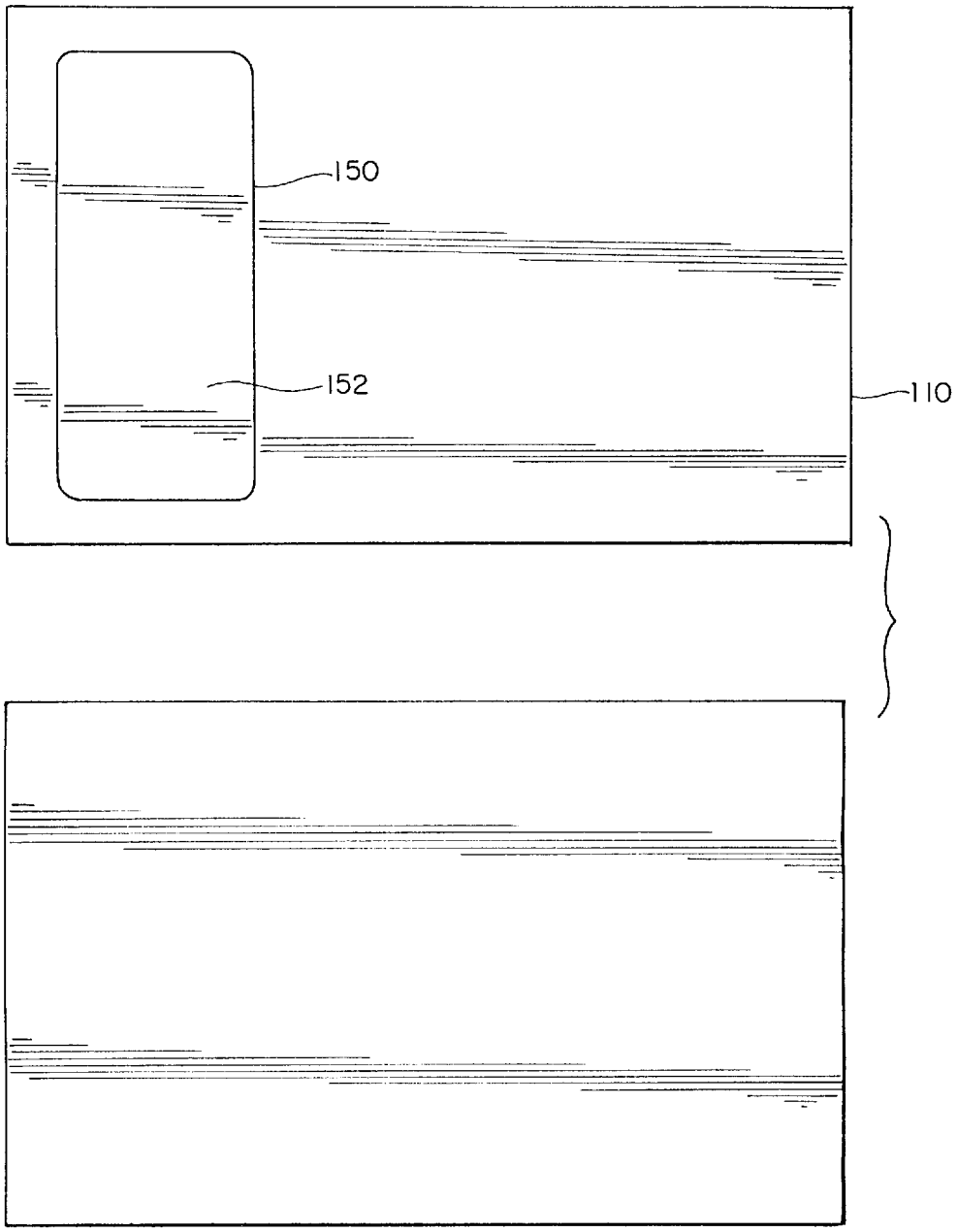
FIG. 18 is a top view of the page of FIG. 17 of a paper label where the laminate is on the opposite side showing where the paper sheetstock is kiss die-cut to the release liner to form a removable label.
Figure 19:
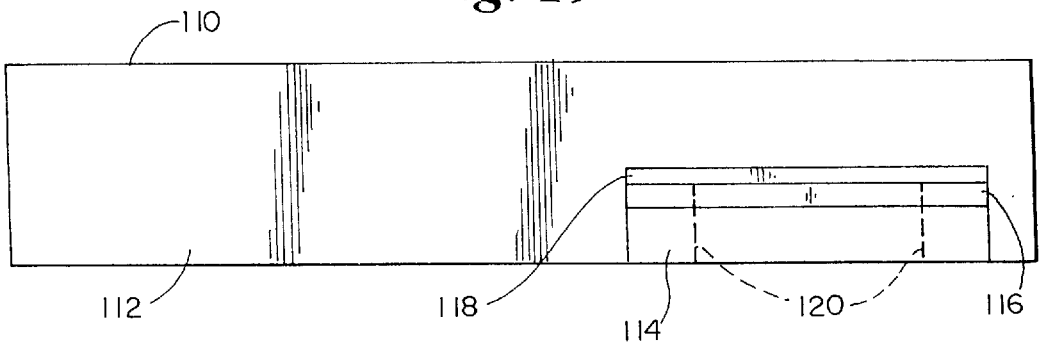
FIG. 19 is a cross-sectional view of the page of FIG. 16 where the label can be peeled off the paper sheetstock or optionally peeled off inside of the die-cut area from the same side as the label material is compressed into the sheetstock.

In FIG. 14 it will be seen that the sheetstock 10 is largely formed by single sheet 58 which is formed with two recessed areas 60, 62. If desired, only a single recess may be used. A plastic layer may be added to the opposite side of the paper of the recess if two layers of plastic are desired without employing two recesses, as shown in FIG. 15. However, it is important that the overall thickness of the area where the plastics are adhered to the core sheet is approximately the same thickness as the balance of the sheetstock forming functionally equivalent thickness as the balance of the paper sheetstock and is coplanar. The recessed areas 60, 62 receive adhesive 64 which secures plastic layers 66, 68 to sheet 58.

The sheetstock will be even on a sheet-feeder and will feed smoothly therethrough.

Reference numeral 72 refers to a strip of magnetic material on a plastic substrate which will function as a magnetic encoded information carrying device on the cards. The strip may be printed or adhered on top of the paper but underneath the outside layer of plastic to provide protection to the media. The magnetic strip may be added to any of the cards of the invention, and may also be coated or added as a separate layer as in FIG. 15 or next to the top plastic 66 as in FIGS. 13, 14. The magnetic strip may be the same as any conventional strips which are currently found on many bank cards and is available through 3M Co., of St. Paul, Minn. In FIG. 13 the die cuts may pass through the strip 72 and the plastic 66 to define the outline of the card 70 that may be separated later. The magnetic ink may also be added directly on top of the plastic or on the underside of the plastic. In a similar manner, holographic images may be formed into, on top of, to the side of, or underneath the cards of the invention. Invisible fluorescent ink that will glow when placed under a black light may also be printed on the paper under the plastic where it can't be easily tampered with, directly on top of the plastic laminate, or on the adhesive or inside the plastic laminate. Additional colored fluorescent inks may also be added. It is also possible a security feature called "Confirm Security Laminate Systems" from 3M Co. in St. Paul, Minn. may be used. Other security features commonly found in the business forms industry may also be used.

Labels

Example 7

With reference to FIGS. 16 to 19 it will be seen that sheetstock 110 is formed from a page of paper 112 to which a bottom layer of plastic or paper 114 is adhered by adhesive 116. Compressible plastic, imprintable plastic, or paper layer 112 is fabricated from papers and plastics or plastics with coatings currently in use in laser printing or other imprinting as already mentioned in this patent with the application in mind. A coating 118 is added to paper stock 112 which forms a barrier so that adhesive 116 will not stick permanently to paper 112. There are a variety of such coatings available and are often known as release coatings and often have silicone in them. The laminate, adhesive and barrier coating are compressed into paper 112 by using a roller method described in Holmberg U.S. Pat. No. 4,447,481. Optionally, die-cuts 120 can be added to the sheetstock to form the shape of the label(s) desired. These die cuts are generally a continuous cut to the depth of the release liner. Die cuts (not shown) could also extend all the way through the paper sheetstock 112 if the application requires the portion of the sheetstock and label to be removed from the core sheetstock.

Example 8

Figure 20:
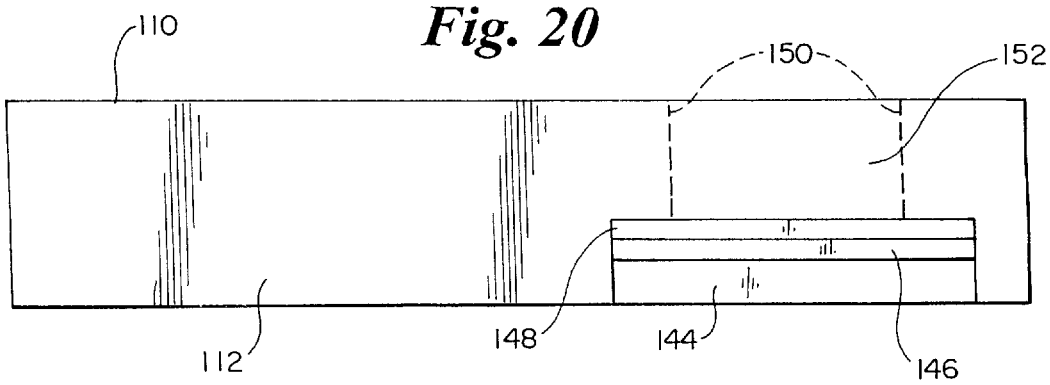

FIG. 20 shows sheetstock 110 formed by paper stock 112 which has paper, plastic or imprintable plastic layer 144 added in the recessed area. A coating 146 is added to paper stock 112 which forms a barrier so that adhesive 148 will not stick permanently to paper 112. Die cuts 150 can be cut through paper stock 112 to a depth up to release liner coating 146. This will allow for removal of paper label 152 from the form with adhesive 148 sticking to it.

Example 9

Figure 21:
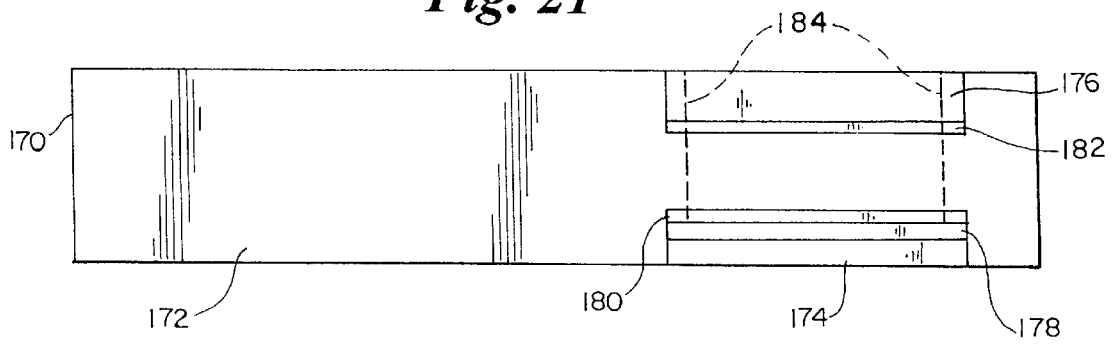
FIG. 21 is a cross-sectional view of a variant of the page of FIG. 16 where plastic and or paper is laminated to both sides of the sheetstock and die-cut from one side so as to allow for the release of a combination paper and plastic label.
Figure 22:
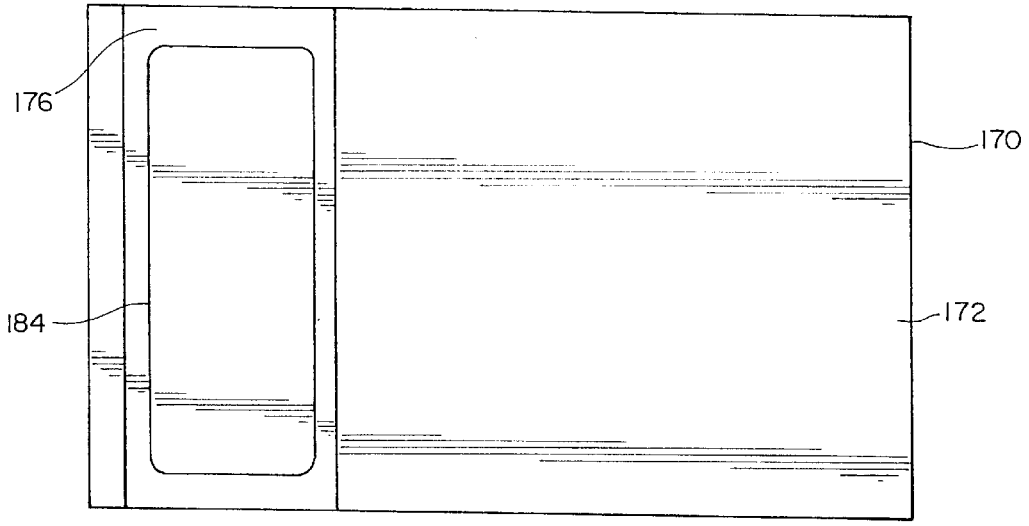
FIG. 22 is a top view of page of FIG. 21 where laminates are on two sides of the sheetstock and a die cut is cut through one of the laminates and through the paper core through the adhesive and to the release liner.

Another construction is shown in FIG. 21. Sheetstock 170 is formed of paper 172 that has paper, plastic or imprintable plastic laminates 174 on one side and paper, plastic or imprintable plastic laminates 176 adhered to paper 172 on the side opposite 174. Release liner 178 is adjacent to layer 174. Adhesive 180 is between release liner 178 paper 172. Adhesive 182 is between layer 176 and paper 172. Die cuts 184 are kiss cut through layer plastic 176 and adhesive 182 to a depth up to release liner 178. Optionally, an additional die cut (not shown) can be cut through all layers of material to facilitate easy removal of all layers from sheetstock 170 as with the plastic identification cards. This would be done if the application required removing the entire substrate from sheetstock 170 and then peels away the desired layers to expose the adhesive and form the label. An example of where this construction may be used is for laser imprintable name badges that need to be mailed. This construction also allows for printing on the paper.

Wristbands

Example 10

To form a laser-imprintable wrist band for a hospital or a label that needs to be wrapped around something such as a strap on a bag at an airport for a luggage tag, the release liner may only be needed to be applied in a spot instead of a continuous strip.

Figure 34:
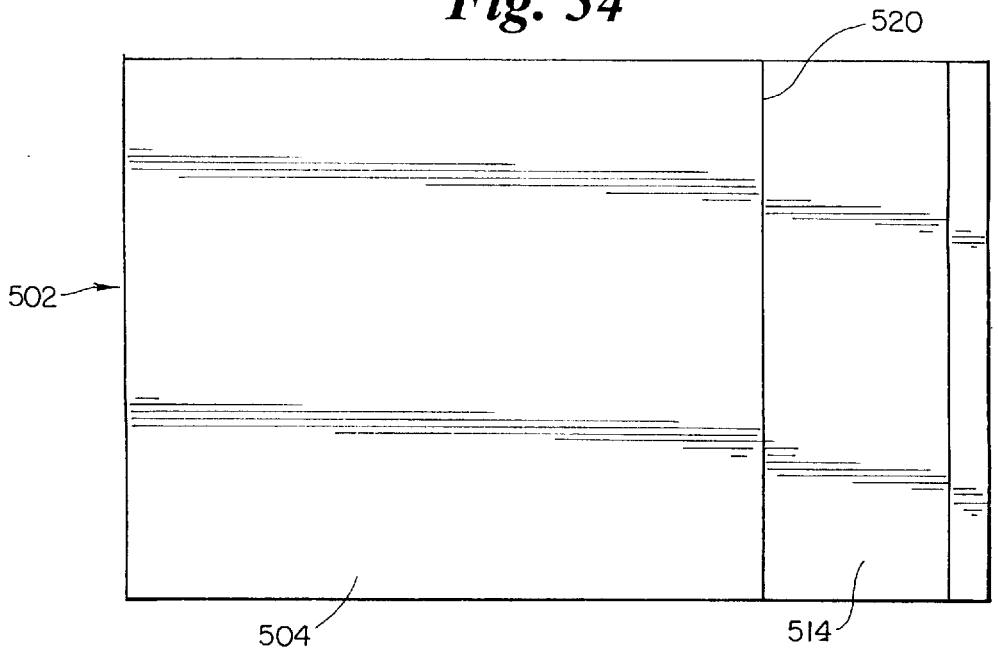
FIG. 34 is a bottom view of the sheetstock of FIG. 33.
Figure 35:
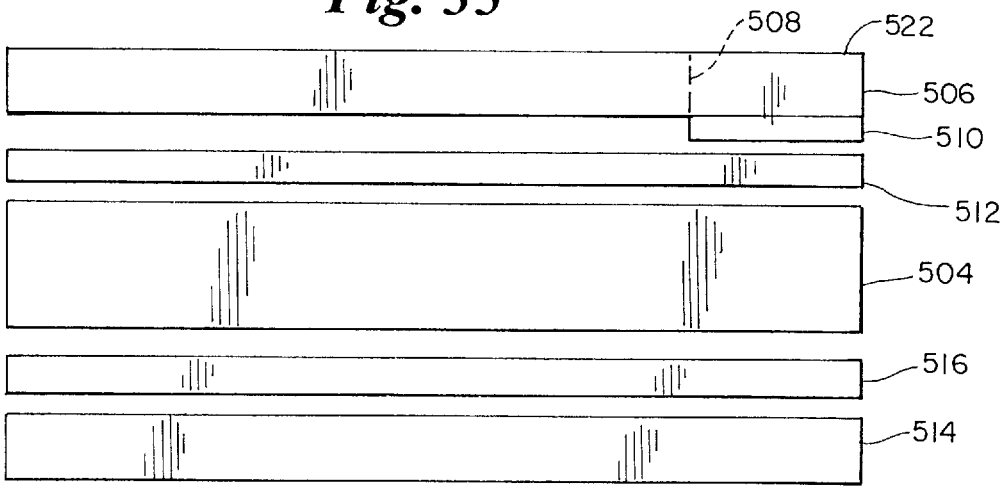
FIG. 35 is a side view of the sheetstock of FIG. 33.
Figure 36:
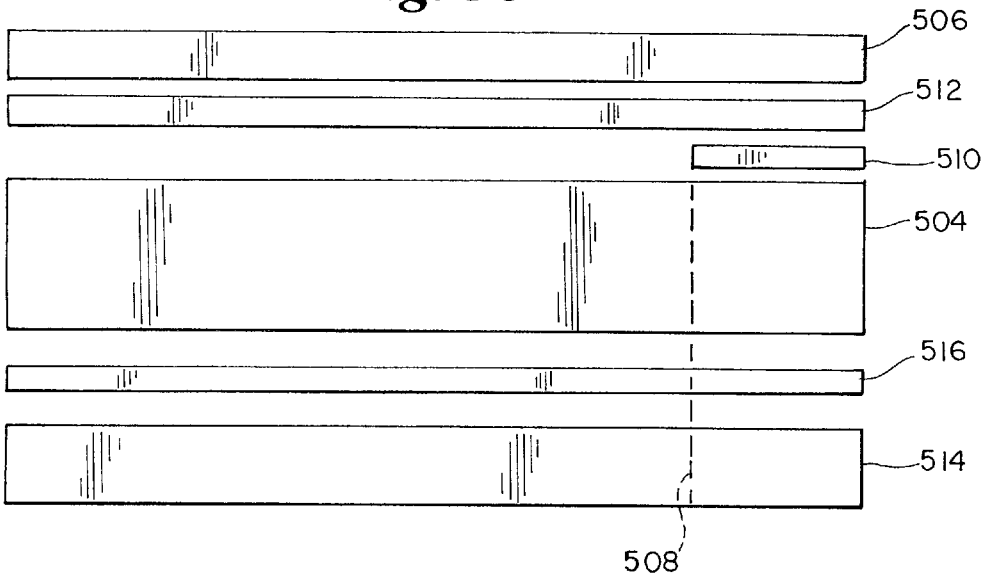
FIG. 36 is a side view of an alternate construction to the wristband shown in FIG. 35.
Figure 37:
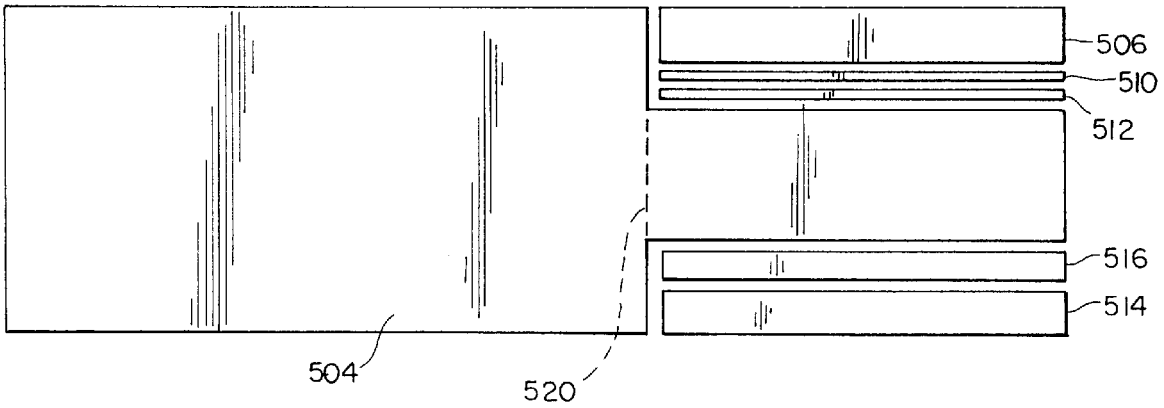
FIG. 37 is a side view of the wristband sheetstock of FIG. 33 showing the indented areas.

The plastic is die-cut in such an area so that the protective strip can be removed from a small area exposing the adhesive to stick to something else or to itself. FIG. 33 through 37 show the sheetstock 502 of paper 504 with indented areas filled with plastic layers 506, 514, release layer 510, and adhesive layers 512, 516. As an alternate construction, FIG. 34 shows that the release layer 510 may be below the adhesive 512 such that the adhesive is on the plastic. In such a form, the perforation 508 would go through all but plastic 506.

To use, the sheet would be laser imprinted with information and the wristband portion is formed by detaching at perforation 520. In FIG. 503, the plastic 506 is separated at perforation 508 to expose the adhesive and the small section 522 is discarded or at least rolled back. The wristband is then looped around a wrist (or article) and the adhesive 512 is secured to the opposite end edge of the wristband plastic 514.

Return Envelope Mailers

Example 11

Figure 24:
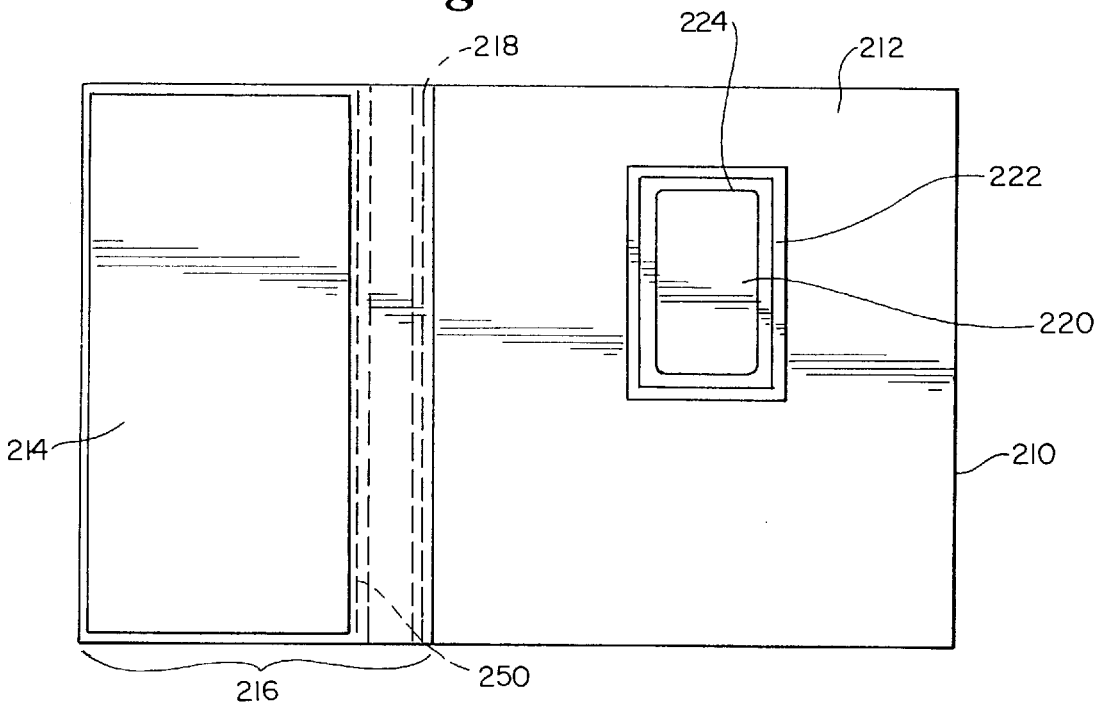
FIG. 24 is a top view of a page of sheetstock bearing a second sheet of paper forming a envelope pouch and also showing the adhesive for the envelope flap and a die cut hole, adhesive surrounding the edge of the hole and translucent patch material adhered to the edge of the hole.

With reference to FIGS. 24 it will be seen that sheetstock 210 is formed from a page of paper 212 to which a top pocket-forming layer of paper or plastic or imprintable plastic 214 is adhered with adhesive 274 on three sides. Paper stock 210 must be made of a paper or plastic that is compressible, strong enough to form a pocket, quite shrink-resistant under the high heat found in most hot fusion laser printers, not expand much with moisture, adheres well to adhesives, and facilitate the adherence of various computerized imaging printers such as various toners, inks from computer ribbons and ink jet systems. An 8 pt. Augusta Bristol paper from Federal Paper Board Company of Montvale, N.J. may work well as the core paper sheet. The paper stock for pocket layer 214 must have the same characteristics as 210 but be thin enough so that it can fit into the recessed area of 210 and keep the overall sheetstock, coplanar Element 216 shows an area that is compressed or indented. Element 218 shows the detachment perforation that allows the return envelope to be removed more easily from the balance of the paper stock to allow for remittance or other use. Such perforation may have a series of cuts and ties or be scored or cut from one or both sides so that it is easy enough to allow for removal of the envelope but also strong enough to keep the form intact as it goes through all areas of manufacture, imaging, mailing equipment and the Postal Service. A hole can be cut in the core sheet stock as shown by 220 that allows for the address area to be seen from the outside of a folded and sealed form if such information was imaged on the inside of a folded mail piece. Translucent patching materials 222 such as Polyester or Glassine as used in traditional window envelopes can be adhered with adhesive 224 to the edge of this hole. The edge of the hole should be indented to allow for the additional adhesive and translucent patching material to not add additional thickness to the form. This adhesive 224 may have the same characteristics of adhesive 274.

Figure 23:
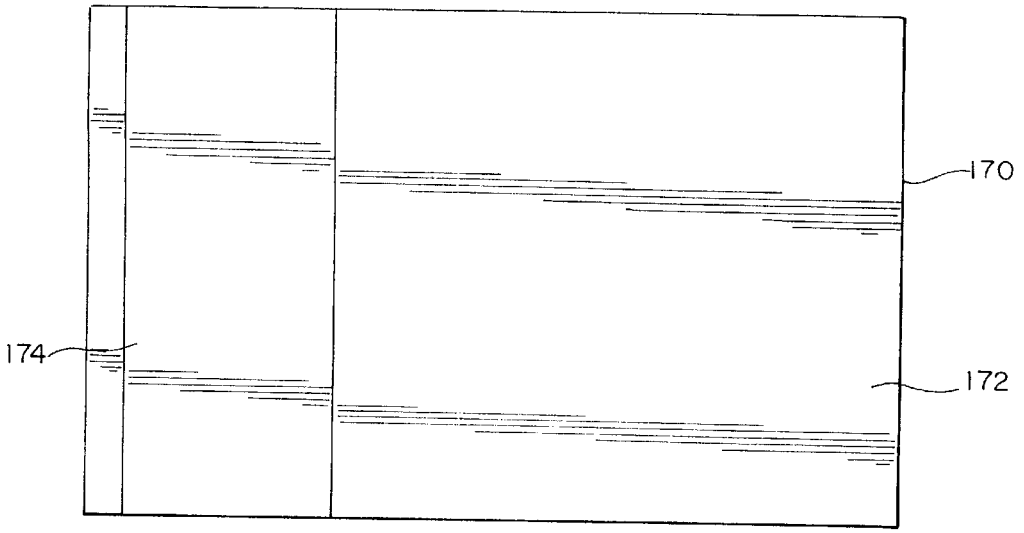
FIG. 23 is a bottom view for FIG. 21.
Figure 25:
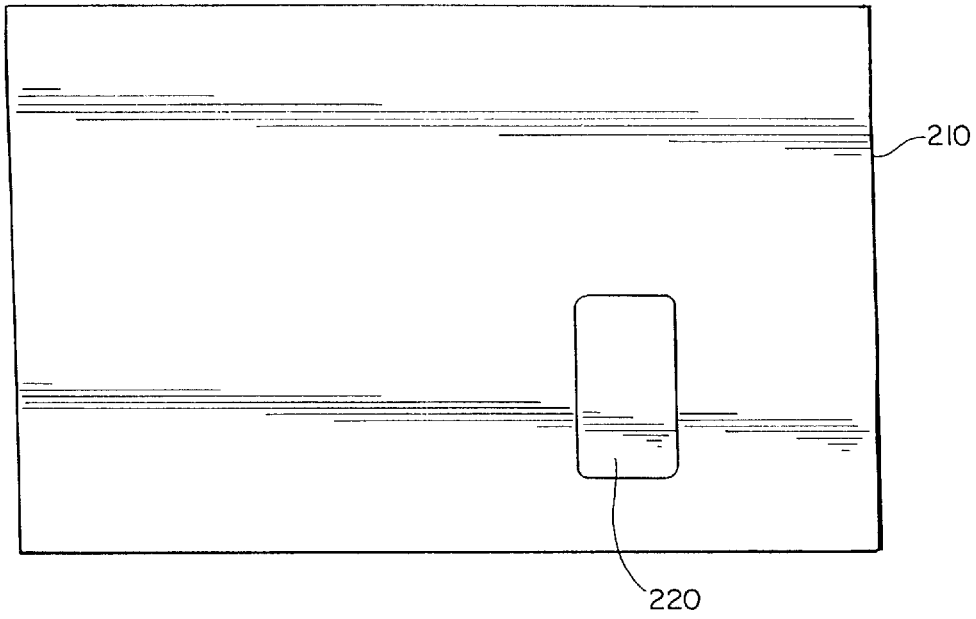
FIG. 25 is a back view of a page of sheetstock in FIG. 24 bearing text and also showing the die cut hole.
Figure 26:
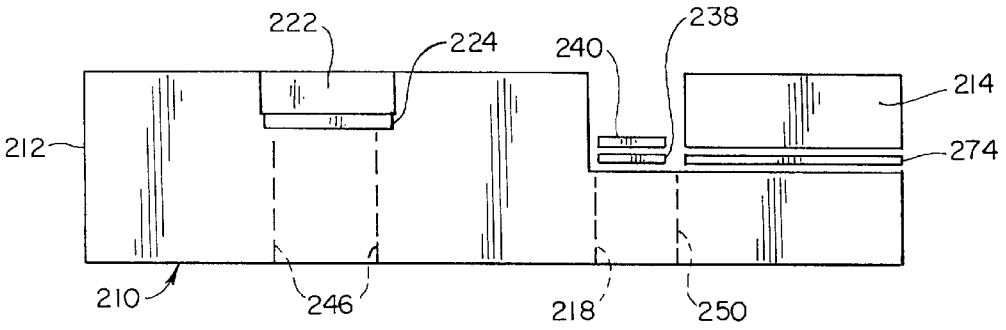
FIG. 26 is a cross-sectional view of the page of FIG. 24; showing the indenting of the core sheet, the positioning of the adhesive to adhere the sheetstock forming the envelope to the core sheet and the adhesive on the core sheet to be used to seal the envelope and optionally the transfer tape, the translucent window material and the adhesive that holds this patch to the core sheet, and the die cut hole.

FIG. 25 shows the opposite side of the sheetstock shown in FIG. 23. The hole 220 for the address window is die-cut through to the back side. Additional holes could be cut through the core sheet to allow for additional information to show through.

Figure 27:
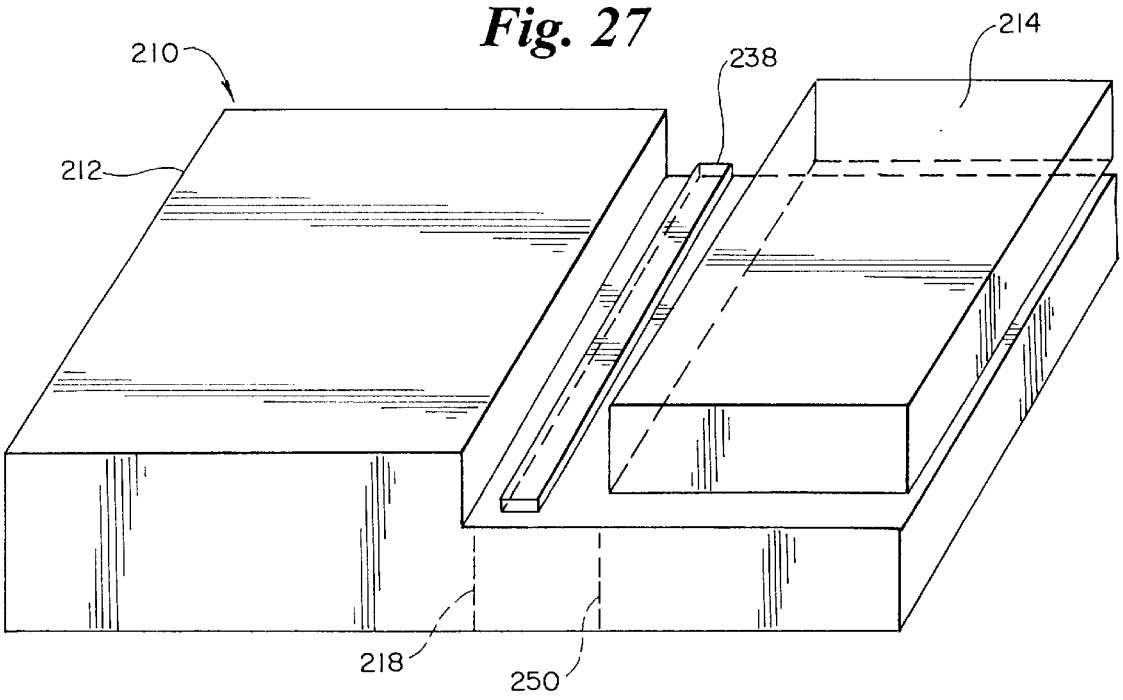
FIG. 27 is an exploded perspective view of sheetstock of FIG. 24 showing the core stock, return envelope paper or plastic laminate stock, rewettable or other adhesive, and detachment perforation with out the permanent adhesive adhering the pocket to the core sheet shown.
Figure 28:
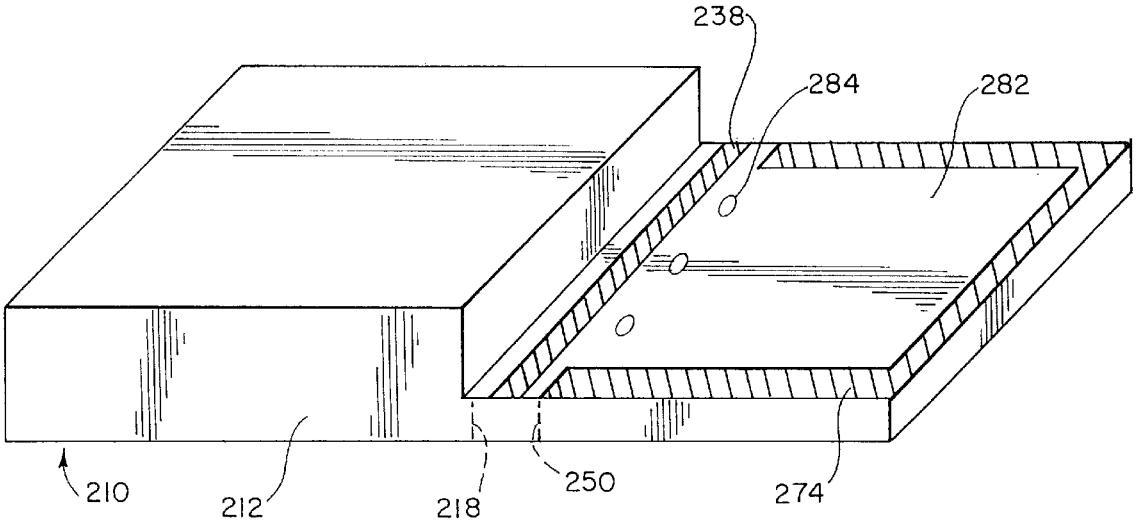
FIG. 28 is a perspective view similar to FIG. 27 with sheetstock 256 broken away showing the positioning of the adhesives which will form the return envelope and the sealable flap for sealing the envelope and also the detachment and flap fold perforations.
Figure 29:
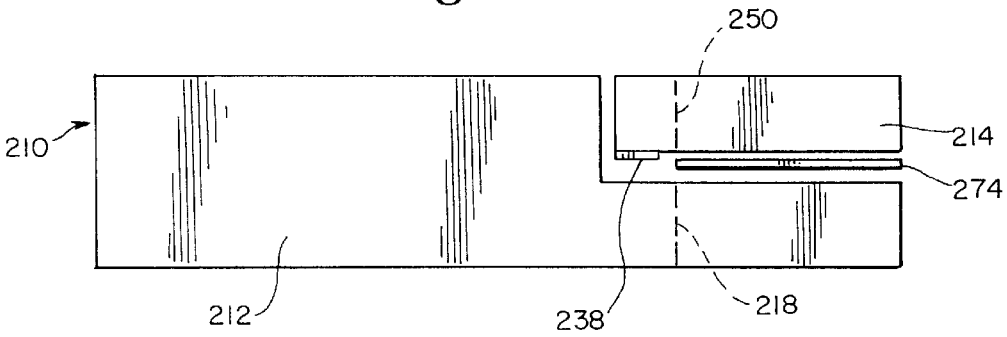
FIG. 29 is a cross-sectional view similar to FIG. 26 except the envelope flap sealing adhesive is on the scab sheet adjacent to the core sheet.

FIG. 27 shows the cross-sectional view of the form. Sheetstock 210 is made from paper or plastic 212 that is indented to allow the aggregate thickness of adhesive 274 and envelope pocket 214 to be the same as and remain coplanar to the portion of paper or plastic sheetstock 214 that is not indented. The adhesive 274 is shown adhering sheetstck 212 to envelope pocket sheetstock 214. The adhesive 274 used must create a strong bond between the two paper stocks forming the pocket, tolerate the high heat found in many hot fusion laser printers, have lay-flat characteristics, and not shrink or expand much, and preferably allow for recycling of the paper stock. This adhesive must not activate or ooze under heat, may be water activated as in licking traditional envelopes and not stick to sheets that are placed on top of it, and should be recyclable. An alternative to this adhesive is to unwind and cut transfer tape 240 so that the recipient of the mail piece can simply remove the protective tape to expose the adhesive which can then be folded over to seal the envelope. Transfer tape could also be added inside the scab sheet flap in place of rewettable glue. Element 224 is the adhesive adhering the translucent plastic or Glassine 222 to the core sheet 212. Dotted line 246 shows where the hole 220 would be cut through the sheetstock for the address window. The detachment perforation is shown by 218. The optional flap fold perforation is shown by 250.

FIG. 27 shows a blown up view of sheetstock 210 and the positioning of paper or plastic sheetstock 212 in relation to sheet stock 214. The rewettable adhesive 238 is also shown as well as detachable perforation 218 and optional fold perforation 250.

Index Tabs

Example 12

Figure 30:
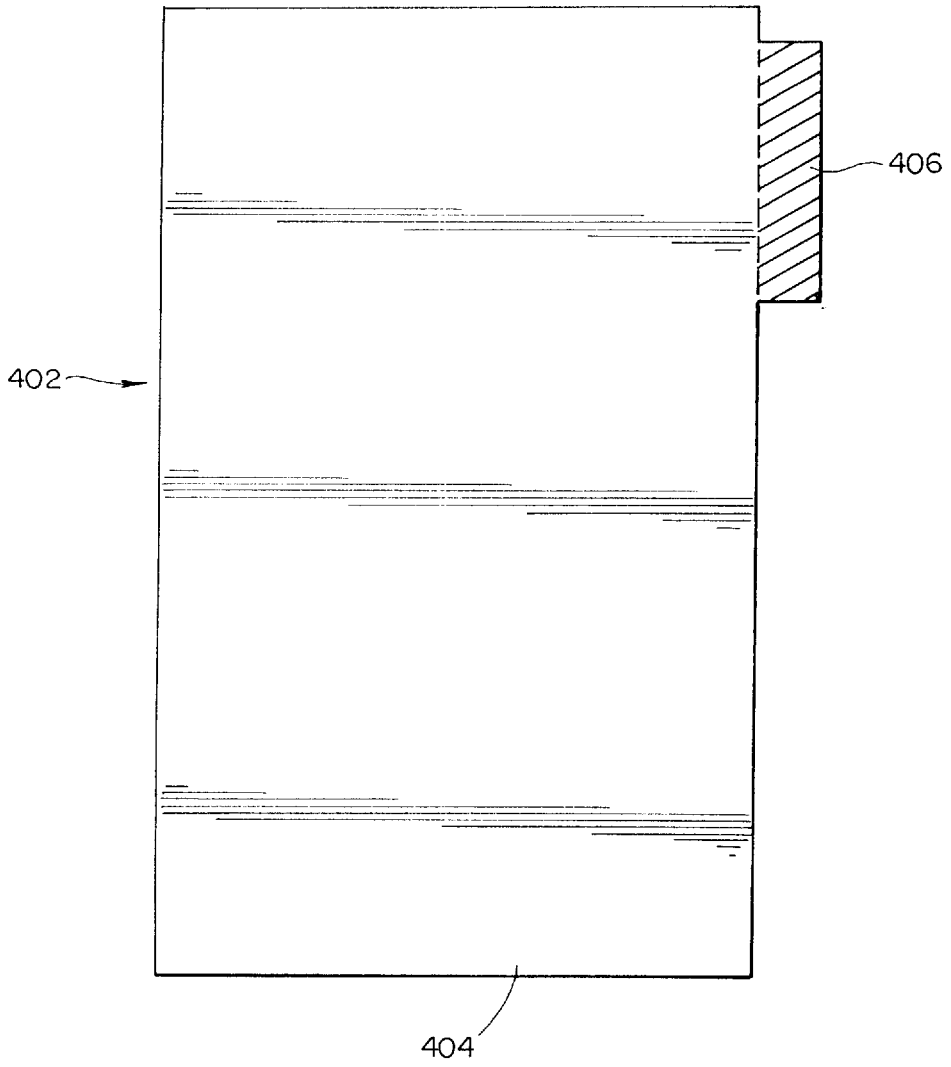
FIG. 30 is a top view of the tab cut form with the imprintable laminate over the top of the tab area.

Index Tab sheets 402 may be readily formed by indenting an edge of paper and applying a layer of printable plastic or other material in the indented region. The excess edge may be trimmed away to make the tab sheet as shown in FIG. 30. FIG. 30 shows a bottom view of the tab sheet 402 and the paper 404 compressed in the tab area and then has adhesive and paper or plastic laminate 406 added to the compressed area to keep the sheet coplanar.

Figure 31:
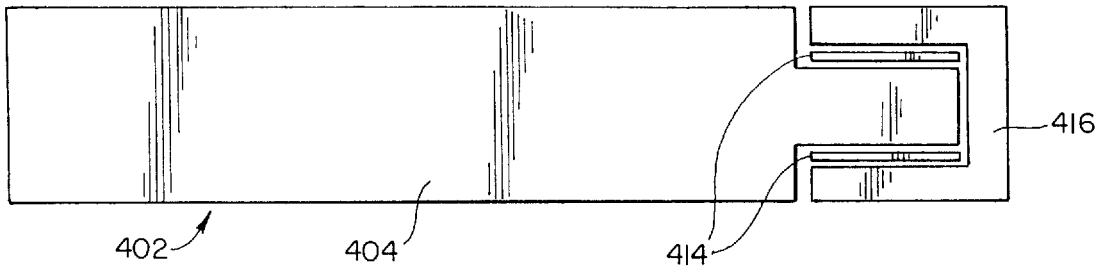
FIG. 31 is a cross sectional view of one laminate wrapped around the compressed paper in the tab area.
Figure 32:
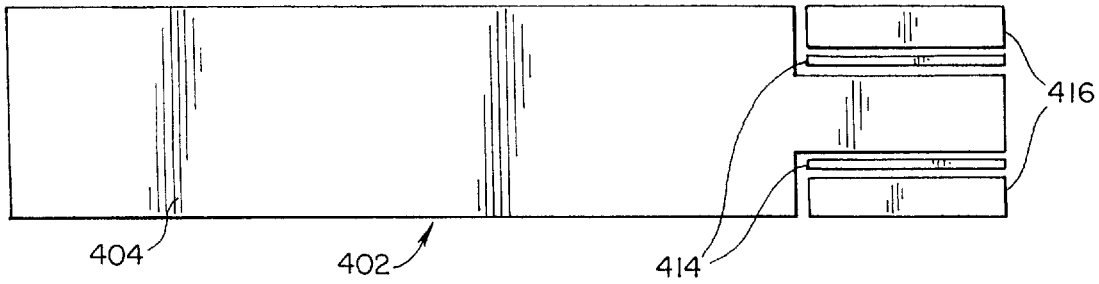
FIG. 32 is a cross sectional view of two laminates adhered to each side of the compress paper in the tab area.
Figure 33:
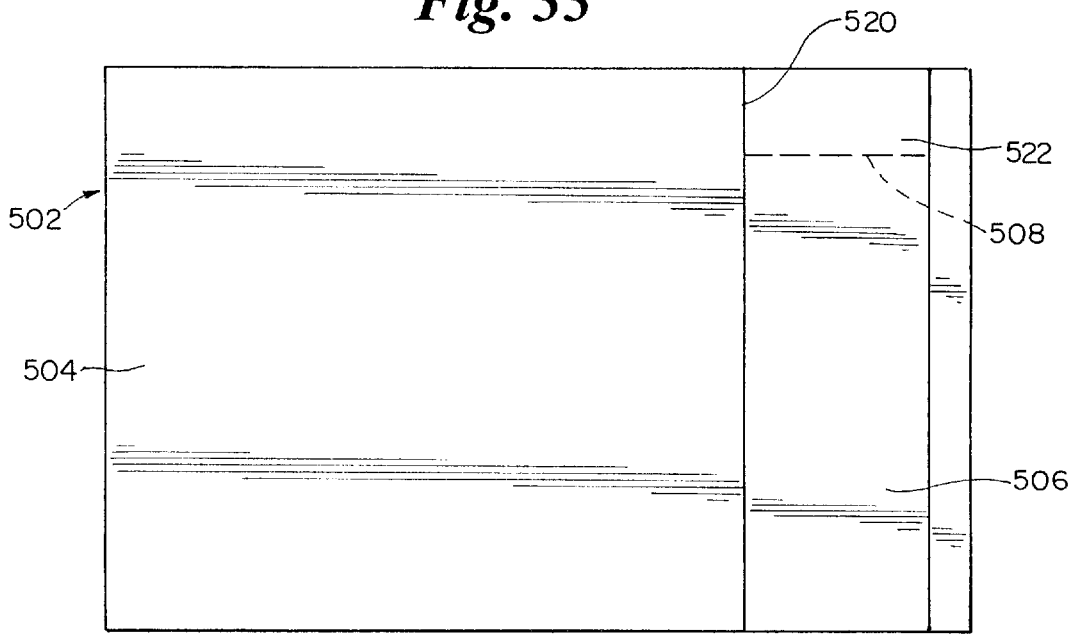
FIG. 33 is a top view of sheetstock that forms wristband material.

FIG. 31 shows a cross sectional view of tab sheet 402 with paper 404 being compressed on two sides. Adhesive 414 secures imprintable plastic 416 wrapped around the paper which is again coplanar FIG. 32 shows tab sheet 402 made from paper 404 with two discrete layers of plastic 416 with adhesive 414. In this form, the edge of the tab is not coated with plastic.

Binder Sheets

Example 13

Figure 38:
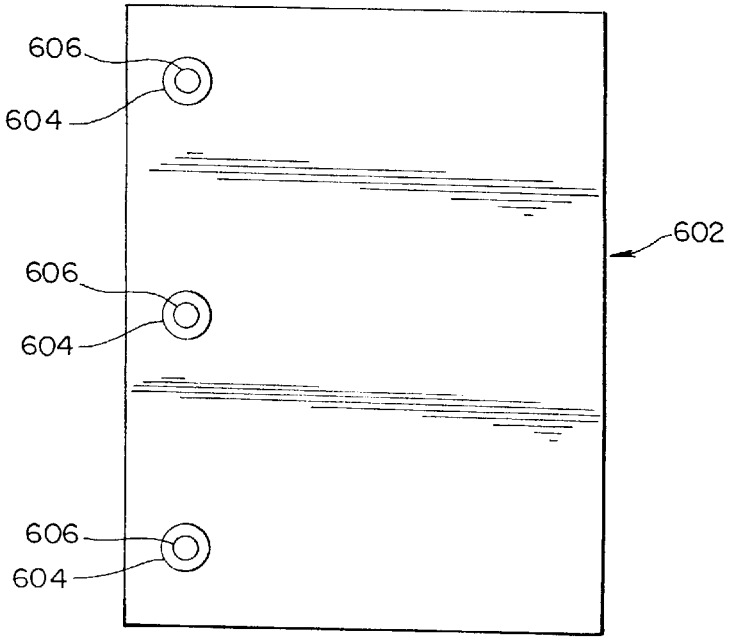
FIG. 38 is a top view of a sheet of paper with reinforced three ring binder holes.

Three ring binders typically are filled with paper that has holes punched along an edge. Glued on reinforcing rings are often added by the users to prevent tearing of the holes. In any punched hole type sheetstock, this invention can provide coplanar sheets with reinforcements. As shown in FIG. 38, plastic 604 may be crushed into sheetstock 602 which is then punched to form holes 606. The entire three-ring sheet is coplanar which allows imaging and stacking without the difficulties associated with simple add-on reinforcing rings.

Preparation of Sheetstock—for Identification Cards

Sheetstock 10 may be in any procedure currently utilized for attaching layers of plastic or paper to a page, such as in advertising flyers or labels. One method for forming the sheetstock would be to use a web finishing machine made by Hunkler of Switzerland to attach second paper layer 30 to paper pages 12 and roll that product onto a large roll to reduce curling the paper stock and subsequent memory curl in the plastic and paper. The paper can then be unwound to a station in which the plastic layer 16 is adhered. The paper may then be rewound onto a roll and unwound to apply the bottom plastic 26. The completed product may be die-cut to form the cards and then be fed to a sheeter where the roll of material is cut to conventional lengths and the cut singles are stacked. This equipment could have modules added to it to allow for the simultaneous laminating of the scab sheet and the two sheets of plastic during the same pass. The plastic could be purchased from an outside vendor such as Dunmore Corporation, as previously described, with the necessary ink, toner, or thermal transfer receptive coatings already on the plastic to provide good toner, ink or thermal transfer image retention and adhesive retention.

In another way to make the scab sheet construction for identification cards, the scab sheet web of paper or plastic is unwound from a different station in the appropriate position with allowance for a gap between the scab sheet and the edge of the plastic laminate and adhered to the core web of paper. The core web has water based pressure sensitive adhesive added to it with a 360 ceramic Anilox roller. The moisture is blown off by dryers. The two webs of paper are nipped together with a roller as is common. The laminated web travels through the print stations where inks can be added to one or both sides of the web. Heat resistant inks are necessary for forms that will travel through a laser printer. The adhered web is then laminated to the plastic that has adhesive on it to one side. The laminate is webbed in the press so that it can have adhesive applied to it from a traditional ink station and 360 ceramic Anilox roller with a sleeve. Various adhesives may be used to meet the demands of the type of printer to be used. For hot fusion laser printers the adhesive must provide a good, preferably fiber tearing bond between the plastic and paper and provide for stay flat characteristics, resist shrinking, and be environmentally preferable and tolerate the heat generated in a hot fusion laser printer of over 400 degrees Fahrenheit. A water based pressure sensitive adhesive number 2319 from Northwest Coatings of Oak Creek, Wis., may work well. To prevent curling of the paper or trapping moisture under the plastic laminate the plastic laminate web with adhesive on it is run through dryers immediately after the adhesive is applied to the plastic with a 360 ceramic Anilox roller to the plastic but before the plastic with adhesive on it is merged and adhered by nipping it to the paper web. The web then runs through a turn bar and travels through additional print stations if printing is desired on the opposite side of the web using the same process. The web is then die-cut in the desired location to form the shape of the card(s) desired, and then run through another series of parallel rollers to crush the perforations, and sheeted or fan folded to the desired size and packaged.

To make the indented construction, one web of paper 110 pound. Springhill Index is unwound and run through a press which prints the face and then is run through a turn bar to print the back in the position desired. The plastic laminate is then laminated to one side of the web. This is done by webbing the plastic laminate so that the adhesive can be applied with a 360 ceramic Anilox roller and sleeve to the plastic, the plastic and adhesive are then dried with air dryers to remove the moisture and then the plastic laminate is nipped with a roller to the web of paper. The web then goes through a turn bar that positions the web so the other side of the web can have a plastic laminate added to it using the same method described for the first laminate. The web with the two laminates added to it then travels through two hardened steel parallel crushing rollers with a circumference approximately 9.6 inches in diameter. The rollers have a raised surface on each side approximately 4 mils of an inch higher than the surrounding surface on the roller and can be slightly wider than the laminates desiring to be crushed which may be 2.5 inches wide. The laminate and adhesive is then crushed into the paper with approximately 43,100 pounds of pressure per square inch to make the web coplanar. The web is then die cut with a roller as is common in the trade with the dies being of shape and size of the card desired. Such dies should have ties in them approximately 1/32 of an inch wide to hold the card in place while being processed in machinery but will still be weak enough to allow for popping out by the end recipient.

The web of die cut paper then travels through a series of parallel rollers hardened steel rollers approximately 9.6 inches in circumference that smooth out any rough edges from the perforations that have gone through the web. The web then goes through a die which sheets the web to the desired size of the form. Optionally, alignment tractor feed holes can be added in the margins to allow the form to feed through various kinds of continuous feed computerized imaging equipment. The form is then packaged in a moisture barrier wrap and then packaged in a carton and sealed.

For the scab sheet construction, it has been found that the paper utilized is preferably a 24 pound wove paper Such paper typically has a thickness of about 0.0045 inches which when adhered to the second paper layer area provides a sheetstock thickness of about 0.010 inches. The plastic layers 16 and 26 are then typically about 0.002 inches each, which combined with the paper page 12 and adhesive 18 and 28 gives a combined thickness of about 0.010 inches. A thicker paper may be required if recesses are to be formed. For the recessed paper sheet a 110 lb. Springhill Index approximately 9.3 mils thick may be used and is available from Hammermill Paper, a division of International Paper Co. Various types of paper and paper thicknesses may be preferable depending upon the application and the type of printer. The plastic may be of varying thicknesses but a 92 gauge plastic as previously noted seems to be preferable as it tends to be strong enough, thin enough to be compressed and heat-resistant enough to remain relatively flat.

Preferably, the laser toner will use a magnetic ink character recognition MICR type toner which fuses better to the plastics and is less susceptible to flaking from the plastic or migration to other plastics. The adhesives should be selected with the application in mind; they must be able to withstand the high temperatures to be encountered in the laser printing process. Any of the commonly used adhesives for such applications involving plastic and paper adhesives may be used. Suitable glues are described in U.S. Pat, No. 4,951, 864. They include vinyl acetate copolymer dispersion adhesives such as a vinyl acetate homopolymer emulsion base having a 58–61% solids content, a formulated resin adhesive with dextrine having a 66% solids content or a resin remoistening adhesive having a 66% solids content. If the adhesive employed allows the plastic to peel free from the paper without fiber tear a coating may be applied to the plastic that will improve the adhesion of the plastic to the adhesive and paper. A wide variety of such primers may be utilized. The plastic surface to be adhered may also be corona treated as is common in the trade to the surface energy level (Dyne level) appropriate to allow the adhesive to adhere to it and provide fiber tearing bond. A corona treatment with a dyne level of 44 should be sufficient.

The sheetstocks 10 thus formed may include a perforation line(s) (not shown) in space 34 to allow the cards 20 to be separated from the upper portion of the sheetstock and to flex more easily. The upper portion of the sheetstock bearing the second paper layer 30 may contain markings, perforations and printed information such that it can function as a return mailer. It may also include die cuts for labels, may carry blown on labels or may be held to the main sheet by a releasable adhesive and release liner system. In such cases, the upper sheet could carry, for example, stickers with emergency phone numbers.

Although the invention is needed most in sheet fed laser printers, it may also be utilized in continuous feed form and would include register holes to align with pins on the printer and perforations at right angles to the web direction to make the make the forms fan fold and burstable. In any case, the invention provides sheetstock which may carry a written message on the second paper or plastic layer 30, back 24 and quality laser printing on one or optionally both sides of the identification cards 20.

This high quality of laser printing, ionographic, magnetographic, dot matrix, impact, LED or ink jet printing when combined with the flat coplanar or functionally equivalent surface area of the sheetstock allows for the placement of printed machine readable bar codes, optical character recognition (OCR) or magnetic ink character recognition (MICR) or pictures on the cards 20. MICR toner uses a ferromagnetic dry ink. Such information means that a holder of such a card may display it at a doctor's office where the bar code is scanned and read, greatly speeding up the process and requiring fewer personnel to make insurance claims. Adding a magnetic strip allows the encoding of much information that may be electronically read as is common with a credit card. Although the configurations of the invention described herein are ideally suited for cut sheet laser printers, they have benefits for the other imaging technologies previously mentioned and can handle digitized pictures and graphics.

The use of the term "identification cards" herein encompasses bag tags, recipe cards, advertising stand up cards, wallet id cards, business cards, credit cards, airline tickets, index cards, tickets, key ring cards and other relatively small cards that bear imprinted identification information.

Whenever "adhesive" is referred to herein it must be remembered that any means for adhering or otherwise attaching the paper and plastics may be utilized. Thus, pressure and heat may be used to attach the plastic layers to the paper. Other adhesion systems may also be used.

While most of the examples specifically refer to the invention and its usefulness with the printers mentioned in this application, other types of printing machines may benefit from using the forms constructions described where a flat configuration must preferably be maintained for good performance. Reference to the term "laser printer". herein is for ease of reading and does not limit the scope of the invention to laser printers.

Preparation of the Sheetstock for Labels

The sheetstock is prepared very similar to the identification cards; except the depth and types of die-cuts, barrier coatings and adhesives may be different.

The die-cuts are "kiss cut" which means they go through the laminates desired to be removed as a label and to a depth up to or slightly into the release liner with the barrier coating on it that traps the adhesive between the desired label material and the release liner barrier coating. This "kiss cutting" is well known in the trade and may be done by adjusting the depth of the die knife on the die rollers. The barrier coatings and adhesives come in a variety of types and should be used with the application, printer type, and end usage requirement in mind.

The paper can be a variety of papers but must comply to the performance requirements of the printer used and have enough thickness and softness to allow for compressing materials and adhesives into it. The plastic can be either coated to facilitate ink, toner or thermal printing or other computer printer imprinting or untreated so that the balance of the sheetstock can be personalized by computer imprinting or also so that the label's information can be static as in a "yes-no sticker" for a direct mail solicitation.

Preparation of the Sheetstock for Index Tabs

A web of paper is unwound and run through a printing press or any other such machine. A web of plastic is adhered to one edge of the paper. The plastic laminate has a water based pressure sensitive adhesive applied and moisture dried off as described already. The plastic laminate is then plow folded around the edge of the paper and adhered on the other side of the paper. The laminated area is then crushed with two raised and adjacent crushing rollers as already described in the plastic laminated area to make the form portion with adhesive on two sides of the paper and plastic on each side to be coplanar with the balance of the paper form. The edge of the web may then die cut to the desired shape of the tab and the waste is disposed of or the waste may remain on the form via a perforation so that the form can run through certain types of printers and then the waste is removed later by breaking the perforations. An alternate to this construction would be to have two plastic laminates adhered to the form's paper core from two sides and then crushed into the edge of the paper web with two adjacent rollers with raised surfaces to make the laminated area coplanar with the balance of the paper core form. Again, the edge of the web would be die cut to the tab shape desired and the waste would be removed from the balance of the form. The paper edge may be crushed, die cut to the tab size and plastic may be affixed. Alternatively, the paper may be compressed, cut to form a tab, and laminates may be affixed over a tab.

Preparation of the Sheetstock—Two Way Envelope

One method for forming the sheetstock 210 would be to take a roll of paper and unwind it in a printing press. From one station of the press add permanent adhesive 274 to the sheet stock 212 using a pattern gluing method as is common in the trade in the pattern of a "U" shape so that the adhesive forms the shape desired for the return envelope. From another station add the strip of rewettable adhesive 238 or unwind the transfer tape 240 for adhering the seal flap to the envelope. From another station unwind a roll of the laminate 214 that forms the return envelope in the position desired. If a die cut hole 246 is desired for the address to show through, a bi-level die could be used that would cut the hole 220 and indent the paper surrounding the hole that has been cut in the form. The paper stock that has been die-cut out could be vacuumed away and disposed. A plastic or glassine window patch 222 could be attached to sheet 212 with adhesive 224 to cover the hole in the area surrounding the hole that has now been indented using tipping on or patching equipment found in the trade and commonly used for making envelopes. A flat roller would be run adjacent to a roller having a raised area on it similar to Holmberg U.S. Pat. No. #4,447,481 that would compress the form in the area where the second sheet of paper or plastic stock has been added to form the envelope pouch. If the paper sticks together where the scab sheet is crushed into the core sheet a layer of coating 282 could be added to one or both sheets such as silicone that would lessen or eliminate the possibility of the sheets sticking together before or after crushing. Small nonpermanent or permanent adhesive glue dots 284 may also be added inside the throat of the envelope that will keep the envelope in position during the imaging process. The web would then be sheeted using traditional sheeting equipment or perforated, have continuous form tractor feed holes added, if desired, and fan folded to form a continuous form as is common in the trade into the desired size and packaged as required.

An alternative method, of manufacture would be to take the core sheet web of paper and compress it immediately with the rollers and then add the adhesives and scab sheet as above and sheet or fan fold to make the finished product. The advantage of this method is that this method does not put pressure onto the scab sheet by a roller that could cause a weakening of the already thin sheetstock and envelope and also smooth the sheet so much that toner will not stick well to it because the paper is not toothy enough due to its crushing. This may also reduce the possibility of the return envelope portion from sticking together. A coating may be applied to make the toner adhere better.

Another alternative construction has the adhesive used for sealing the envelope by the end recipient adjacent, to the core sheet on the scab sheet flap. Such a design is to prevent the adhesive from coming into contact with and possibly damaging or contaminating the printer.

While this invention may be embodied in many different forms, there are shown in the drawings and described in detail herein specific preferred embodiments of the invention. The present disclosure is an exemplification of the principals of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. Sheetstock comprising:

a) a first sheet of plastic or paper;

b) a second sheet of paper or plastic having a lesser surface area than and being adhered to one portion of said first sheet;

c) said sheetstock having functionally equivalent thickness in all portions thereof; and d) at least a portion but less than the whole of said second sheet being readily separable from the remainder of said sheetstock.

2.The sheetstock of claim 1 in which said portion of said second sheet is readily separable from the remainder of said sheetstock as a composite together with that portion of the first sheet on which it is superimposed.

3. The sheetstock of claim 1 in which said portion of said second sheet is readily separable from the remainder of said sheetstock and from said first sheet on which it is superimposed.

4. The sheetstock of claim 1 further including release layer interposed between an adhesive adhering said second sheet to said first sheet, and wherein cuts through said second sheet define at least one adhesive-bearing label that may be separated from said first sheet for attachment bv said adhesive to another surface after being imprinted.

5. The sheetstock of claim 2 further including a release layer interposed between said first sheet and an adhesive adhering said second sheet to said first sheet, and wherein cuts through said second sheet but not through said first sheet define at least one label that may be separated for attachment to another surface after being imprinted.

6. The sheetstock of claim 1 wherein said separations extend through said first sheet and second sheet and are arranged such that a portion of said second sheet and first sheet may be separated leaving a tabbed sheetstock.

7. The sheetstock of claim 1 further including a third sheet of paper or plastic attached to said first sheet opposite said second sheet, said first sheet being constructed and arranged such that said sheetstock has functionally equivalent thickness in all portions thereof.

8. Sheetstock comprising:

a) a first sheet of plastic or paper;

b) a second sheet of paper or plastic having a lesser surface area than and being adhered to a portion of said first sheet;

c) said first sheet being constructed and arranged such that the upper surface of said second sheet is coplanar with the remaining upper surface of said first sheet; and d) wherein adhesive is applied between said first sheet and said second sheet such that said adhered sheets form a pocket.

9. The sheetstock of claim 8 further including means for detaching said pocket from the remainder of said first sheet.

10. The sheetstock of claim 9 further including adhesive for adhering said second sheet to said first sheet to close said pocket.

11. The sheetstock of claim 1 including means for separating a strip of first sheet and second sheet that are adhered together from the remainder of said first sheet.

12. Sheetstock comprising:

a) a first sheet of plastic or paper;

b) a second sheet of paper or plastic having a lesser surface area than and being adhered to one portion of said first sheet;

c) said sheetstock having functionally equivalent thickness in substantially all portions thereof;

d) at least a portion but less than the whole of said second sheet being readily separable from the remainder of said sheetstock; and e) means for separating a strip of said first sheet and said second sheet that are adhered together from the remainder of said first sheet; her including a release coating between said second sheet and said first sheet that allows a portion of said second sheet to be removed exposing an adhesive that may be used to adhere to another part of the strip.

13. Sheetstock for preparing adhesive-backed printable labels comprising:

a) a first sheet of paper having an upper and lower surface;

b) a layer of printable plastic or paper having a lesser surface area than and being adhered to one portion of said first sheet, said plastic or paper layer including separation means to define therewith at least one readily removable adhesive-backed label; and c) said sheetstock having functionally equivalent thickness in all portions thereof.

14. Sheetstock for preparing a return envelope mailer capable of being printed comprising:

a) a base sheet of paper having an upper and lower surface and means for separating said base sheet into a first and second portion;

b) a layer of printable paper or plastic having a lesser surface area than said sheet and being adhered along all but one of its edges to said second portion of one surface of said base sheet to form a pocket therewith, such that said formed pocket may be detached from the first portion of said base sheet; and c) said sheetstock having functionally equivalent thickness in all portions thereof.

15. The sheetstock of claim 14 further including adhesive means for adhering the open edge of said layer to said base sheet to thereby close said pocket.

16. The sheetstock of claim 15 further including a layer of translucent material adhered to an indented region about an opening cut through said base sheet such that a window is formed.

17. Sheetstock comprising:

a) a first sheet of paper having an upper and lower surface;

b) a layer of printable paper or plastic having a lesser surface area than said sheet and being adhered to one surface of said sheet, said sheet and layer including separations therethrough to define therewith at least one readily re movable portion; and c) said sheetstock having functionally equivalent thickness in all portions thereof.

18. Sheetstock comprising:

a) a first sheet of plastic or paper;

b) a second sheet of paper or plastic having a lesser surface area than and being adhered to one portion of said first sheet;

c) said first sheet being constructed and arranged such that the upper surface of said second sheet is coplanar with the remaining upper surface of said first sheet; and d) at least a portion but less than the whole of said second sheet being readily separable from the remainder of said sheetstock.

19. Sheetstock capable of being printed comprising:

a) a sheet of paper having an upper and lower surface;

b) a layer of printable plastic or paper permanently adhered to a portion of one surface of said sheet, forming a composite, said composite having one or more removable sections; and c) said sheetstock having functionally equivalent thickness in all portions thereof to facilitate handling in a printing process.

20. Sheetstock comprising:

a) a first sheet of plastic or paper;

b) at least one opening through said first sheet;

c) a second layer of paper or plastic having a lesser surface area than and being adhered to said first sheet around at least one of said openings; and c) said sheetstock having functionally equivalent thickness in all portions thereof.

21. Sheetstock comprising:

a) a first sheet of paper having an upper and lower surface;

b) a layer of paper or plastic having a lesser surface area than said sheet and being adhered with adhesive to one surface of said sheet, said sheet including separations therethrough to said layer to define therewith at least one readily removable portion, said portion being removable from said underlying layer along with adhesive such that said portion removed includes an adhesive layer; and c) said sheetstock having functionally equivalent thickness in all portions thereof.

* * * * *

UNITED STATES PATENT AND TRADEMARK OFFICE
CERTIFICATE OF CORRECTION

PATENT NO. : 5,842,722

DATED : Dec. 1, 1998

INVENTOR(S) : Thomas S. Carlson

It is certified that error appears in the above-identified patent and that said Letters Patent is hereby corrected as shown below:

Col. 4, line 21, delete "," after the word holding;

Col. 10, line 7, delete "yes no label" and insert -- yes - no label --;

Col. 25, line 28, delete "her" and insert -- further --;

Col. 26, line 12, delete "re movable" and insert -- removable --;

Signed and Sealed this

Fourth Day of April, 2000

*Attest:*

*Attesting Officer*

Q. TODD DICKINSON

*Director of Patents and Trademarks*